US006851663B2

(12) United States Patent
Satterfield

(10) Patent No.: US 6,851,663 B2
(45) Date of Patent: Feb. 8, 2005

(54) FLUID EMULSIFICATION SYSTEMS AND METHODS

(76) Inventor: John R. Satterfield, 248 S. Ave., Poughkeepsie, NY (US) 12601

( * ) Notice: Subject to any disclaimer, the term of this patent is extended or adjusted under 35 U.S.C. 154(b) by 0 days.

(21) Appl. No.: 10/387,692

(22) Filed: Mar. 12, 2003

(65) Prior Publication Data

US 2003/0160341 A1 Aug. 28, 2003

Related U.S. Application Data

(63) Continuation of application No. 09/885,649, filed on Jun. 20, 2001, now Pat. No. 6,540,210, which is a continuation-in-part of application No. 09/400,403, filed on Sep. 21, 1999, now Pat. No. 6,281,253, and a continuation-in-part of application No. 09/131,185, filed on Aug. 7, 1998, now Pat. No. 6,211,251.

(51) Int. Cl.[7] ..... F02M 19/08

(52) U.S. Cl. ..... 261/23.2; 261/DIG. 12; 261/DIG. 56

(58) Field of Search ..... 261/23.2, 62, DIG. 12, 261/DIG. 56

(56) References Cited

U.S. PATENT DOCUMENTS

| | | | | |
|---|---|---|---|---|
| 484,721 A | | 10/1892 | Parris | 261/123 X |
| 656,409 A | | 8/1900 | Laraway et al. | 261/123 X |
| 797,615 A | | 8/1905 | Schmitt | 261/124 X |
| 1,041,480 A | * | 10/1912 | Kaley | 261/154 |
| 1,144,342 A | | 6/1915 | Andrews | 261/123 X |
| 1,822,888 A | | 9/1931 | Haysel | 261/79.1 X |
| 1,969,960 A | * | 8/1934 | Blum | 261/79.2 |
| 1,985,165 A | | 12/1934 | Hapgood | 261/123 |
| 1,994,766 A | | 3/1935 | Hagler | 261/123 X |
| 2,029,556 A | | 2/1936 | Brown | 261/124 X |
| 2,034,430 A | * | 3/1936 | Farrow et al. | 261/50.1 |
| 2,118,220 A | * | 5/1938 | Mock | 261/44.7 |
| 2,525,083 A | * | 10/1950 | Stresen-Reuter | 261/39.2 |
| 2,985,524 A | * | 5/1961 | Jacobus | 48/189.3 |
| 3,245,666 A | | 4/1966 | Marsee | 261/65 |
| 3,330,773 A | | 7/1967 | De Hart, Jr. | 516/10 |
| 3,429,676 A | | 2/1969 | Galza | 261/123 X |
| 3,685,808 A | * | 8/1972 | Bodai | 261/1 |

(List continued on next page.)

FOREIGN PATENT DOCUMENTS

| | | | | |
|---|---|---|---|---|
| JP | 55-75558 A | | 6/1980 | 261/123 |
| JP | 57-193762 | * | 11/1988 | 261/DIG. 12 |

OTHER PUBLICATIONS

Alex Walordy, Carb Mods, Stock Car Racing, magazine, Feb. 1998, pp. 100–107.

Mike Ulrich & Bill Fisher, Holley Carburetors & Manifolds, book, 1976, H.P. Books, Tucson, AZ.

William H. Crouse & Donald Anglin, Automative Mechanics, book, 1985, Tenth Edition, Glencoe–McGraw Hill, Ohio.

Julian Moxon, How Jet Engines Are Made, book, 1985, Facts on File Publications, Ner York.

*Primary Examiner*—Richard L. Chiesa
(74) *Attorney, Agent, or Firm*—Douglas W. Rudy

(57) ABSTRACT

This invention describes systems and methods for mixing two fluids. A first fluid, usually fuel, can be passed through a primary passage that typically leads to a carburetor or other inlet to a combustion engine. A second fluid, usually air, can be mixed with the first by introducing it to the primary passage through an inlet located upstream in the primary passage. The mixture of fluids can then be further emulsified by passing it over a plurality of obstructions, such as a threaded interior surface of the primary passage, located within the primary passage downstream of the inlet.

2 Claims, 19 Drawing Sheets

U.S. PATENT DOCUMENTS 3,756,580 A 9/1973 Dunn ..... 261/123
3,848,858 A * 11/1974 Page et al. ..... 261/63
3,962,381 A 6/1976 Farrish et al. ..... 261/123 X
4,206,158 A * 6/1980 Wood ..... 261/62
4,217,313 A * 8/1980 Dmitrievsky et al. ..... 261/41.5
4,308,835 A * 1/1982 Abbey ..... 123/439
4,387,685 A * 6/1983 Abbey ..... 123/439
4,518,540 A * 5/1985 Takayasu ..... 261/18.3
5,472,645 A 12/1995 Rock et al. ..... 261/79.1
5,827,455 A * 10/1998 Nakai ..... 261/23.2
5,863,470 A * 1/1999 Grant ..... 261/23.2
6,211,251 B1 * 4/2001 Satterfield ..... 516/10
6,281,253 B1 * 8/2001 Satterfield ..... 516/10
6,540,210 B2 * 4/2003 Satterfield ..... 261/62

* cited by examiner

FLUID EMULSIFICATION SYSTEMS AND METHODS

This application is continuation of Ser. No. 09/885,649, filed Jun. 20, 2001, now U.S. Pat. No. 6,540,210; which is a continuation-in-part of Ser. No. 09/400,403 filed Sep. 21, 1999, now U.S. Pat. No. 6,281,253 and is a continuation-in-part of Ser. No. 09/131,185 filed Aug. 7, 1998, now U.S. Pat. No. 6,211,251. This application is also related to Ser. No. 09/671,929, which is now abandoned. Each of the aforementioned applications are herein incorporated by reference. All U.S. patents or patent applications, published or appended articles, and any other written materials incorporated by reference into either of the aforementioned applications are also specifically incorporated herein by reference.

FIELD OF INVENTION

This invention relates generally to fluid emulsification systems and methods, including fluid delivery systems for combustion engines and similar applications, including gas, diesel and jet engines. More specifically, this invention also relates to systems and methods that promote uniform and homogenous emulsification of a liquid (such as fuel) by blending a gas (such as air) with the liquid and then supplying this blended mixture to an engine. One application of the invention is in fuel delivery systems, such as used for internal combustion (including gas and diesel engines) or jet engines, where thorough and homogeneous emulsification of the fuel and air, and the supply of this mixture in augmentation of a primary fuel supply system, results in greatly increased engine efficiency. Also disclosed are improvements in carburetor fuel passages, including the relative positioning of boosters and venturis in carburetors and other flow enhancing attachments that have an effect on booster and overall carburetor efficiency.

BACKGROUND OF INVENTION

Emulsification of a fluid stream occurs by introducing air or gas into the fluid stream, and is beneficial in many applications. For example, it is known to form an emulsion of air with fuel flowing to the carburetor of an internal combustion engine, with the benefit of increasing the efficiency of combustion. The more homogeneous and complete the air is emulsified with the fuel, the more efficient the combustion process will be. Combustion that is more efficient results in better performance with reduced pollution and emissions. Emulsification of a fuel charge with air is beneficial not only in standard combustion engines, but also in diesel engines and other applications such as jet engines, turbines, home heating systems, paint spraying, perfume dispensing, and the like.

Many prior art systems have attempted, without success, to achieve complete fuel/air emulsification. Most of those systems relate to emulsification of fuel with air for an internal combustion engine. Some such systems attempt to emulsify the fuel downstream of the venturi region of a carburetor, while other such systems attempt emulsification within the venturi region. Still other systems attempt emulsification at the point of fuel delivery. Those prior art systems fail to completely, or homogeneously, emulsify the air and fuel mixture.

FIGS. 1 and 1A are simplified diagrams depicting a standard carburetor having a known emulsification system as used in commercially available Holley® carburetors. Several references discuss the general subject of carburetor operation. See, for example, *Super Tuning and Modifying Holley Carburetors,* by Dave Emanuel (S-A Design Books, E. Brea, Calif., 1988), and *Holley Carburetors,* by Mike Urich and Bill Fisher (HP Books, Los Angeles, Calif., 1987). Both of those books are incorporated herein by reference. Their descriptions of carburetor operation include short discussions on the importance and operation of an emulsion tube in a carburetor.

In the normal operation of a carburetor, the fuel 8 is delivered from a source 10 to a float bowl 12. A float 14 meters the amount of fuel retained in the bowl through a valve system such as a needle and seat assembly 15. The fuel enters a main well 18 through a power valve circuit 16 and/or a main jet 17. The downward stroke of a piston in the engine creates a differential between atmospheric pressure and the pressure in the engine cylinder. The pressure differential creates a partial vacuum in the venturi region 22 of a booster of the carburetor and draws the intake air 23 through the venturi of the booster as well as through the venturi in the throat or throats of the carburetor. The venturi effect in the booster causes the fuel to discharge through nozzle 20 forming a mixture 24 of ambient air and fuel. This air-fuel mixture passes through throttle valve 25 and the intake manifold system to the cylinders, where it is combusted by engine 26.

The prior art carburetor of FIGS. 1 and 1A include an emulsion tube 28 shown in communication with the main well 18 through one or more air channels or ports 30. The emulsion tube 28 obtains air from an air intake orifice 32, which is typically located upstream of the venturi portion of the carburetor. The mixing force of the air attempts to break down the fuel into an air/fuel mixture before it enters the venturi region of the carburetor. However, the mixing is not homogeneous or complete, and is only partially effective.

More specifically, the deficiency in the design of FIGS. 1 and 1A results primarily because the walls of the main well 18 and emulsion tube 28 are simple smooth walled cylinders. Therefore, the air introduced into the fuel stream follows a path of least resistance, which in the smooth bore well design, is an uninterrupted path close to the surface of the wall. In FIGS. 1 and 1A, small circles ("o") represent the air and dashes ("--") represent the fuel. An emulsification is represented by a homogeneous distribution of air and fuel. As shown most clearly in FIG. 1A, the air drawn through the emulsion tube 28 mixes with the fuel only in a local or limited area close to the smooth walls of the main well 18. There are no provisions in the main well 18 to keep the air and fuel in a frothy emulsified state or to continuously direct, redirect or tumble the air back into the flowing fuel 8. Therefore, the air-fuel mixture remains primarily in a stratified form with only incomplete or partial emulsification of the fuel occurring at the areas where air enters air inlets or bleed holes 30 of the main well 18.

Other prior art is likewise not successful at fully emulsifying the air-fuel mixture. For example, U.S. Pat. No. 3,685,808 to Bodai describes a fuel delivery system that attempts to emulsify the fuel by introducing supersonic swirled air through a single air inlet positioned tangent to the end of the fuel nozzle. However, in actuality, the air does not swirl at all, but takes the shortest route by primarily flowing straight through and following the smooth contour of the fuel delivery tube. The air and fuel thus remain in a relatively stratified form. There will be some fuel aeration at the point where the non-swirling air enters the fuel delivery tube through the single air inlet. However, the complete air-fuel mixture is at best only partially aerated. U.S. Pat. No. 1,041,480 to Kaley purports to disclose a system that aggravates the intake air in the air channel down stream from the fuel nozzle. The wall of the intake air channel of the Kaley patent is threaded or knurled in an attempt to aggravate the intake air prior to mixing with the fuel. In reality, the knurled or threaded surface of the intake air channel causes an unwanted "throttling" effect thus restricting the flow or volume of air and fuel delivered to the combustion area.

U.S. Pat. No. 4,217,313 to Dmitrievsky et al. attempts to accomplish the creation of an air-fuel emulsion by trying to swirl air down-stream from a venturi. Air above the throttle valve, and at the same pressure as the upstream throttle chamber, passes around the throttle in a separate air passage to a circular air chamber below the venturi. Dmitrievsky teaches that the air pressures both above the throttle valve and in a separate air chamber below the venturi are higher than that of the down-stream throttle chamber. Therefore, the intake air above the throttle valve is supposedly forced into the air passage leading to the circular air chamber. Dmitrievsky presumes that the circular shape of the air chamber will cause the air to swirl vigorously and exit an annular passageway. A depression in the annular passage (venturi effect) then causes the air to move at sonic velocity. Dmitrievsky teaches that because the air is at sonic velocity and swirling, the invention achieves fine atomization and uniform mixing of the air and fuel. However, conventional testing has established that the swirling of air in such a configuration is almost non-existent. As a result, the air-fuel mixture will in all likelihood remain in the same stratified state as the mixture immediately down-stream of the venturi, and thus, is of very little benefit to fuel emulsification.

Italian Patent 434,484 to Bertolotti teaches a fuel/air mixing system that purportedly swirls the air within the main throttle area of the venturi. However, this system does little to promote fuel emulsion. Conventional flow bench testing has determined that any type of rough or threaded surface in the venturi region will only restrict the air flow through the venturi, thus slowing down the throttle response and reducing engine horsepower capabilities.

U.S. Pat. No. 1,969,960 to Blum relates to a drink dispenser used to aerate and mix a liquid drink. The Blum device attempts to mix and aerate the liquid by introducing two fluids (air and a drinking fluid) of equal pressures but different viscosity into a common chamber located above a dispenser nozzle containing a spiral band. However, because the liquids are of different viscosity, the volume of each liquid passing through the dispenser nozzle will be different. In practice, this causes the heavier liquid to separate unevenly from the thinner liquid, and little aeration of the drinking liquid occurs within the nozzle chamber. Most, if not all, of the aeration occurs at the sharp beveled end of the nozzle dispenser that forces the liquid from one side of the dispenser nozzle to the other side of the dispenser nozzle.

U.S. Pat. No. 2,034,430 to Farrow describes a carburetor system in which air enters a mixing chamber through a throttle valve. Within the mixing chamber is a cone having an apex faced in the direction of the main intake air. The surface of the cone is comprised of a grid of longitudinal ribs and a series of circular steps. Fuel enters the mixing chamber through a helix shaped passageway and distributes onto the surface of the cone's ribs and steps. This is supposed to uniformly cover the cone with a thin liquid film of fuel separated into finely divided particles. When main air from the intake enters the mixing chamber, the fuel vaporizes, resulting in a homogeneous air-fuel mixture. This process, known as air stream atomization, does not use a secondary inlet air for fuel emulsification. However, the device does use a secondary idle air intake, but that has nothing to do with fuel emulsification.

U.S. Pat. No. 2,985,524 to Jacobus describes a device that attaches to the delivery side or lower end of the carburetor barrel. The device primarily consists of a nozzle body on the delivery side of the carburetor. The nozzle body that is comprised of a plurality of helical channels that purportedly cause the fuel to spiral or swirl before entering the venturi chamber. However, at no point is air introduced into this delivery system. Therefore, there is no possibility for increased air-fuel emulsification.

In diesel engine applications, fuel economy (i.e., efficient burning of the diesel fuel), is very important. Trucking companies go to great lengths to improve the economy of the over-the-road truck engines. An improvement of even small amounts results in significant savings in fuel costs. However, in diesel engine applications the diesel fuel is injected into either a manifold or the combustion chamber. There is no carburetor in diesel engines although there is an air delivery manifold. Thus, the diesel engine does not use a fuel emulsifier upstream of the injectors. Instead, fuel droplets are formed by the high pressure release of fuel from a small orifice. The droplets are directed into an air stream, which ultimately passes into the diesel combustion chamber.

It is the understanding of the inventor that in jet engines fuel is delivered into a combustion zone of the engine through a plurality of small orifices provided in a fuel delivery nozzle 20 of FIG. 6. The nozzle orifices are on the order of 0.004 inches in diameter. Fuel is pressurized and forced out these small orifices. The amount of fuel delivered is controllable, however the combustion process at high airflow velocities is inefficient. Some of the fuel is not burned before it is forced out the exhaust of the jet engine. No emulsification of the fuel is accomplished upstream of the fuel delivery nozzles as far as is known to the inventor. Based on the current representation of a jet engine as shown in FIG. 6 some air is delivered with the fuel from the fuel delivery nozzle 20.

In view of the above prior art, the need exists to improve fuel atomization in non-diesel engines as well as improve fuel efficiency in diesel engines by more effective emulsification of an air-fuel mixture or, in the case of diesel engines, provide an emulsified fuel/air mixture to the engine's combustion chamber. The emulsification improvement system should have the ability to be easily and readily adapted into most existing fluid delivery systems. Although the specification is largely directed to improved emulsification systems and methods used in carburetors for internal combustion engines, the use of emulsion enhancing fuel delivery elements for use in jet engines is also contemplated. Furthermore, the invention is also applicable other systems where it is desirable to have enhanced emulsification, such as in diesel engines.

SUMMARY OF THE INVENTION

It is an object of this invention to provide an improved fuel emulsion device that is easily incorporated into existing carburetor systems.

It is an object of this invention to improve fuel emulsion and negate fuel stratification by introducing air into the fuel delivery portion of the carburetor through an elongated and threaded fuel channel.

It is a further object of this invention to improve fuel emulsion and negate fuel stratification by causing the air-fuel mixture to roil and tumble to form a frothy emulsion.

It is another object of this invention to improve fuel emulsion by passing the air-fuel mixture over threaded or other knurled surfaces, or over bumps, protrusions, cavities or dimples, before introducing the mixture into the venturi portion of the carburetor.

It is another object this invention to improve fuel emulsion by confining the air/fuel mixture within the main fuel well by using a straight helix or spiral shaped insertion rod that enhances the tumbling of the air/fuel mixture.

It is another object of this invention to provide emulsified fuel to the combustion chamber of a diesel engine.

It is an object of this invention to improve engine performance and fuel economy by providing better and faster combustion of the fuel.

It is a further object of this invention to provide faster and more efficient combustion, thus allowing for a reduction of heat on component contact surfaces and reduction of engine cooling requirements.

It is an object of this invention to provide combustion that is more efficient and to diminish the occurrence of unburned fuel in the combustion exhaust.

It is an object of this invention to reduce the emissions from gasoline or diesel engines by more thorough and efficient combustion of fuel.

It is an object of this invention to improve fuel and airflow through a carburetor by optimizing the position of a booster in the throat of a carburetor.

It is also an object of this invention to optimize fuel and airflow through a carburetor by making the position of the booster adjustable in the throat of the carburetor.

It is another object of the invention to improve fuel and airflow through a restricted carburetor by fitting a flow enhancing apparatus over the intake area of the carburetor.

It is an object of the invention to enhance the flow characteristics of a restricted carburetor by fitting over the intake areas of the carburetor an apparatus that relocates the position of the venturies in the carburetor.

It is an object of this invention to promote air-fuel emulsion for engines that use fuel injection systems to supply fuel to the combustion chamber, including both gasoline and diesel engines.

It is an object of this invention to improve air-fuel emulsion for jet or turbine engines.

It is also an object of this invention to provide an emulsion enhancing fuel nozzle that includes an adjustable air inlet element.

It is another objective of the invention to provide a fuel nozzle that enhances air-fuel emulsion over a wide range of airflow rates and at a range of altitudes and air densities in which a jet engine routinely operates.

It is another object of this invention to provide a fuel nozzle for use in a jet engine or similar applications that enhances emulsification and is formed as a multi-port structure that is machined and assembled, thereby allowing inexpensive construction of a complex internal configuration.

It is an object of this invention to promote air-fuel emulsion for propane engines or natural gas heaters.

It is an object of this invention to promote emulsion formation for paint sprayers.

It is an object of this invention to promote emulsion formation for perfume dispensers.

The above and other objects are achieved by a method for mixing two fluids. The method comprises the acts of passing a first fluid through a primary passage and mixing a second fluid with the first fluid. The second fluid is mixed with the first by introducing it to the primary passage through an inlet located upstream in the primary passage. The mixture of fluids is then further emulsified by passing it over at least one obstruction located within the primary passage down stream of the inlet. In the preferred embodiment of the method, first fluid is combustible fuel and the second fluid is air. To increase the mixing effect, the second fluid may be introduced to the first fluid through a plurality of inlets to the primary passage, and the mixture is passed over a threaded interior surface within the primary passage. Ideally, the threaded interior surface is formed on a portion of the wall of the passage extending downstream between and after each inlet. The emulsifying effect of the present invention is enhanced by restricting the volume of the primary passage to maintain the mixture within a reduced area as it passes over the obstruction(s).

The above and other objects are also achieved by a system for emulsifying a primary and secondary fluid. The system includes a passage for the primary fluid and an inlet for the secondary fluid. The inlet is located upstream in the passage. An obstruction within the passage is located downstream of the inlet for the secondary fluid. In its preferred form, the passage comprises a fuel well leading to a venturi, the inlet for the secondary fluid comprises an air inlet and the obstruction comprises a plurality of raised protrusions extending from an inside surface of the fuel well into the path of the fuel. For example, the plurality of raised protrusions may comprise threads formed on the inside surface of the fuel well. In a modification of the system, a restrictor is placed within the volume of the fuel well. The restrictor may comprise a length of threaded rod placed parallel to the fuel well walls.

The above-described methods and systems have application not only for internal combustion engines, both gas and diesel, but also furnaces, jet engines and other areas where complete emulsification of the two mixtures is desired. In addition, the obstructions in the fuel passages may take any of several forms, including threads, knurls, bumps, protrusions, dimples, cavities, indentations and the like. Also, it is not required that the obstructions, bumps, protrusions, dimples, cavities, indentations etc. be located only in the main well where liquid fuel and air are first mixed and emulsified. These obstructions, bumps, protrusions, dimples, cavities, indentations etc. can be located in any passage or emulsified fuel/air delivery system that contains both air and fuel being delivered to a combustion chamber. For instance, the obstructions and so forth could be in the main delivery tube or main nozzle or in the inside of the booster venturi downstream of the main nozzle. Furthermore, the obstructions can be anywhere downstream of any point where there is a mixing of a liquid and a gas.

The above and other objects are achieved in an embodiment of the invention applicable to jet engines, wherein the fuel delivery and emulsifier nozzle includes a flared portion having an increased diameter relative to the initial or upstream section of the nozzle. In the preferred form of this embodiment, the emulsifier nozzle in a jet engine comprises a plurality of air inlets along the initial straight and subsequent flared portion of the nozzle. This nozzle may also comprise a turning zone toward the exhaust end of the nozzle wherein the fuel and air emulsion passing through the nozzle may be directed toward a preferred path.

The above and other objects are achieved in an embodiment of the invention applicable to diesel engines and four cycle gasoline engines, wherein a quantity of emulsified fuel is prepared in a carburetor and delivered through the air intake manifold to the combustion chambers of the engine. A fuel charge of injected fuel augments the quantity of emulsified fluid delivered to the engine by a conventional intake manifold.

The above and other objects are also achieved by adjusting the position of the venturi booster (also referred to herein as the "booster"), in the throat of the carburetor relative to the venturi ("venturi" refers to the narrow internal diameter of the carburetor throat) to optimize the effect of the venturi. In a modified form of this embodiment, the booster is mounted in the throat of the carburetor so that its position is adjustable.

The above and other objects of the invention are also achieved by forming an insert to be placed over the carburetor and having a number of air runners corresponding to the number of runners or carburetor throats in the host carburetor. Each runner of the insert can have a constant diameter throat, or can alternatively have decreasing or increasing throat dimensions. In one embodiment the throats of the insert can be a venturi therein that either augments, effectively repositions, blends with or replaces a standard venturi in a standard location in the throat of a carburetor. By altering the location of the venturi to the location of the optimum signal (for drawing an optimum mixture of emulsified fuel into the intake flow stream) the highest efficiency of the carburetor can be attained.

The preferred embodiments of the inventions are described in the following Detailed Description of the Invention. Unless specifically noted, the words and phrases in the specification and claims are intended to have their ordinary and accustomed meaning to those of ordinary skill in the applicable arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

The preferred embodiment, characteristics, and benefits of the present invention can be more easily understood from the following description of the preferred and alternative embodiments in combination with the accompanying drawings, in which.

DETAILED DESCRIPTION OF THE INVENTION

In describing a preferred embodiment of the present invention, references are made to FIGS. 1–19 of the drawings in which like numbers refer to like features of the invention. None of these figures present the invention and the environment in true scale. That is, the relationship and sizes of various illustrated components are presented to convey the essence of the invention and provide a teaching of the invention. In an actual embodiment, the emulsion tube when used in a conventional carburetor for instance would have a diameter on the order of 0.25 inches. Moreover, in alternative embodiments (e.g., jet engines) the scale would be much larger. Once the invention is understood in its preferred form, one of ordinary skill in the art can easily apply it to applications other than a conventional carburetor.

Figure 1:
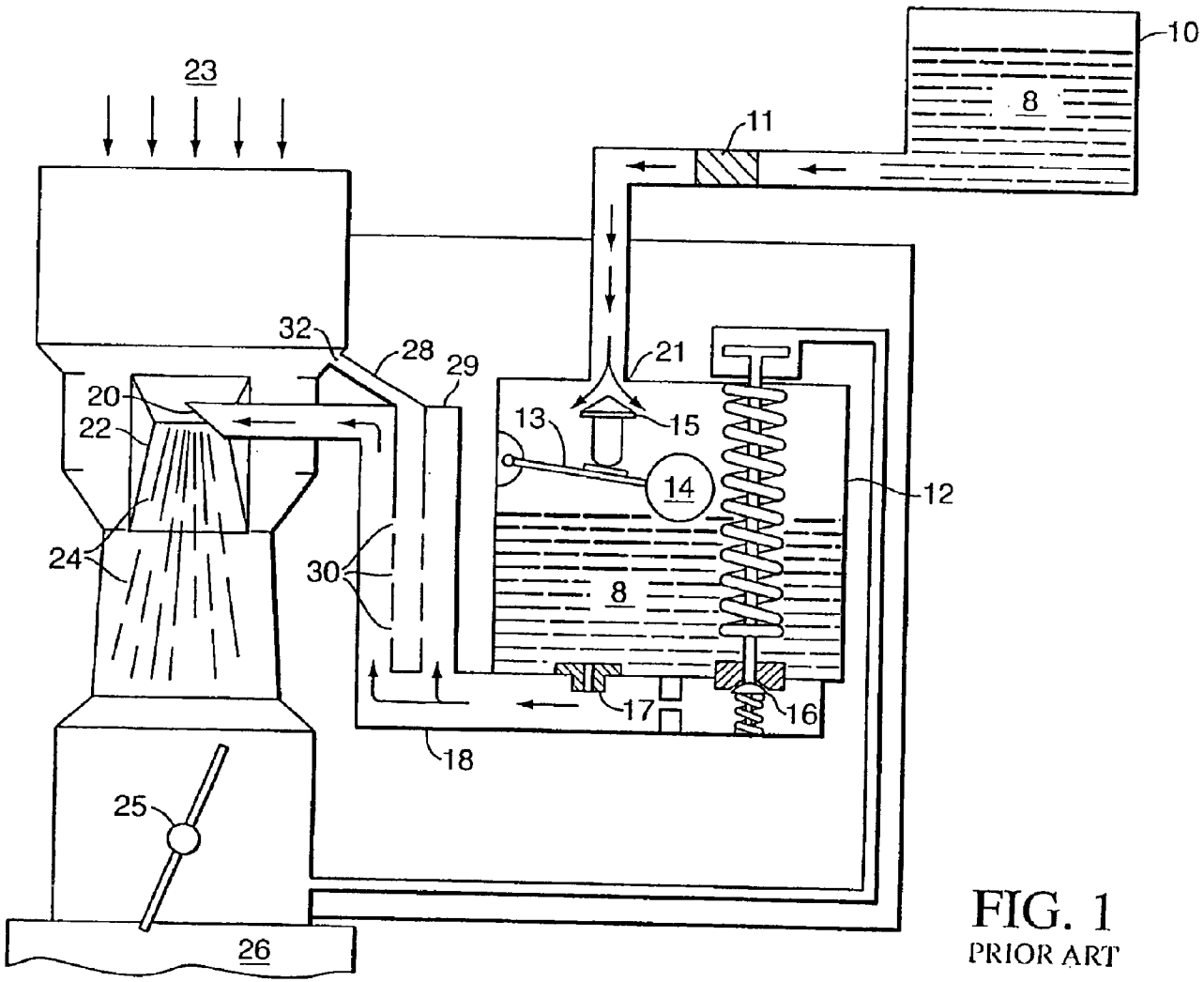
FIG. 1 PRIOR ART
FIG. 1 is a cross sectional functional view of a simplified pictorial representation of a Holley® carburetor and fuel supply system.
Figure 1A:
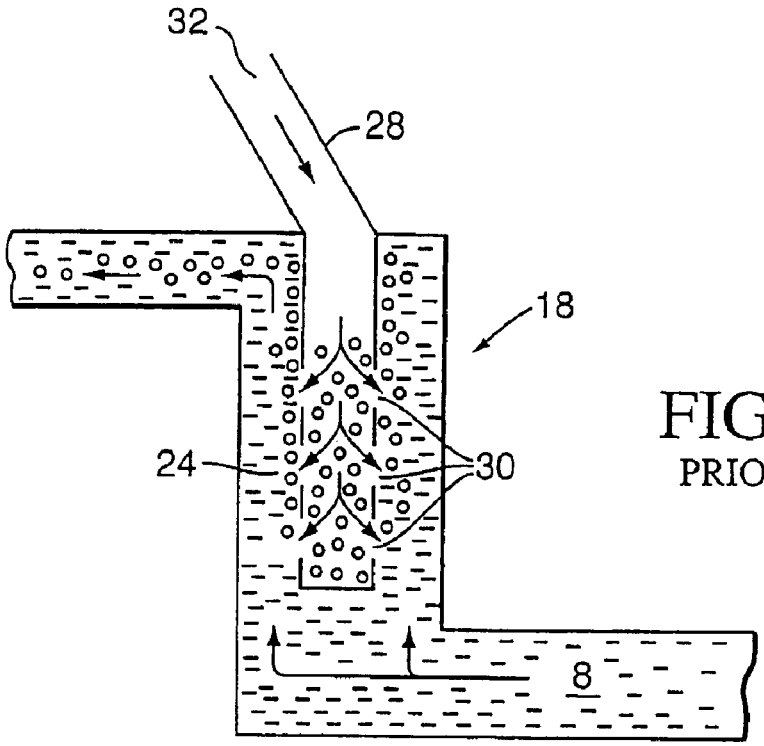
FIG. 1A PRIOR ART
FIG. 1A is a pictorial representation of a main well of a carburetor as found in the Holley® carburetor of FIG. 1.

FIGS. 1 and 1A depict a prior art form of carburetor. Fuel 8 flows from a source 10 in the direction of the arrows and passes through a screen or filter 11, a needle and seat valve assembly 15, and into fuel bowl 12. As fuel fills the fuel bowl 12, it lifts a float 14. Coupled to float 14 is a hinged lever arm 13 that pushes on the needle of the valve assembly 15 when the float 14 rises. When the fuel 8 in the fuel bowl 12 reaches a preset level, the needle 15 seals against a seat 21, thus shutting off fuel 8 to the fuel bowl 12 and main well 18. This process continuously repeats itself as the operation of the engine 26 drains the fuel bowl 12. The standard forms of emulsion tubes attempted in such prior art devices are discussed above in the Background of the Invention.

FIGS. 2A through 2E depict an improved emulsion system that promotes the maintenance of a homogeneously emulsified air-fuel mixture in the main well of the carburetor.

Figure 2A:
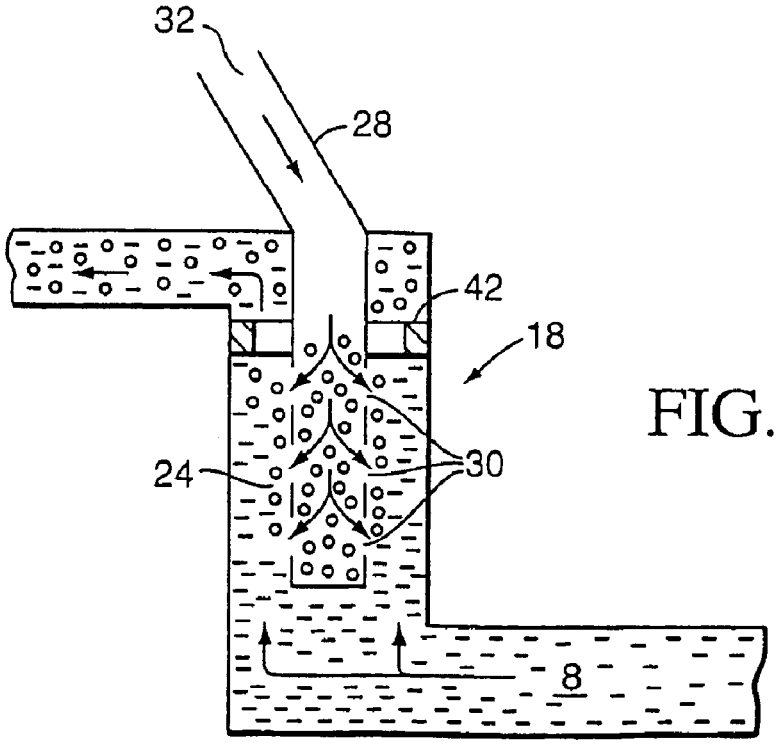
FIG. 2A is a schematic representation of one embodiment of the invention that improves the operation of the carburetor of FIGS. 1 and 1A.
Figure 2B:
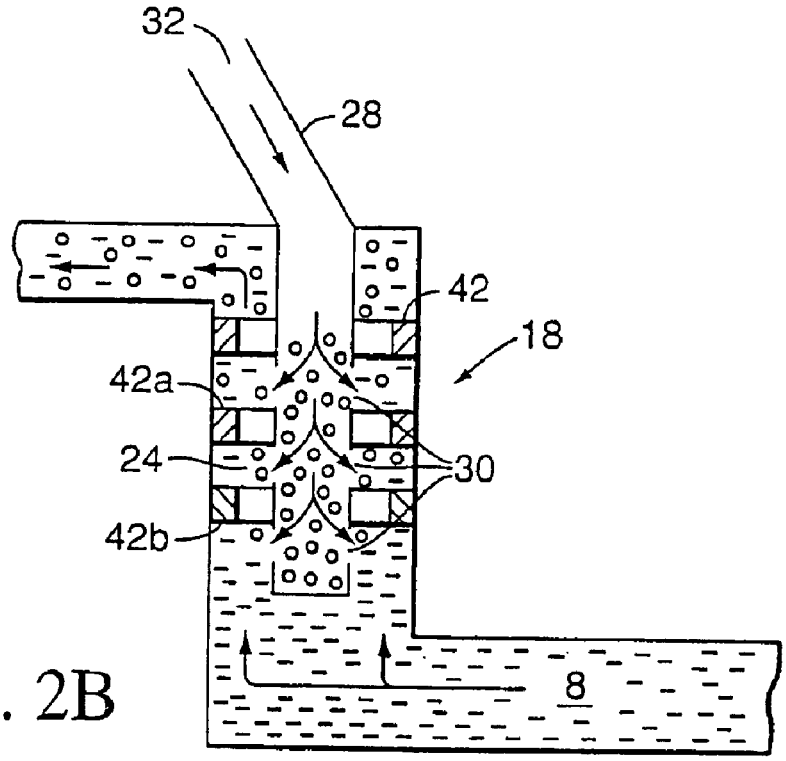
FIG. 2B is an alternative embodiment of the invention shown in FIG. 2A.
Figure 2C:
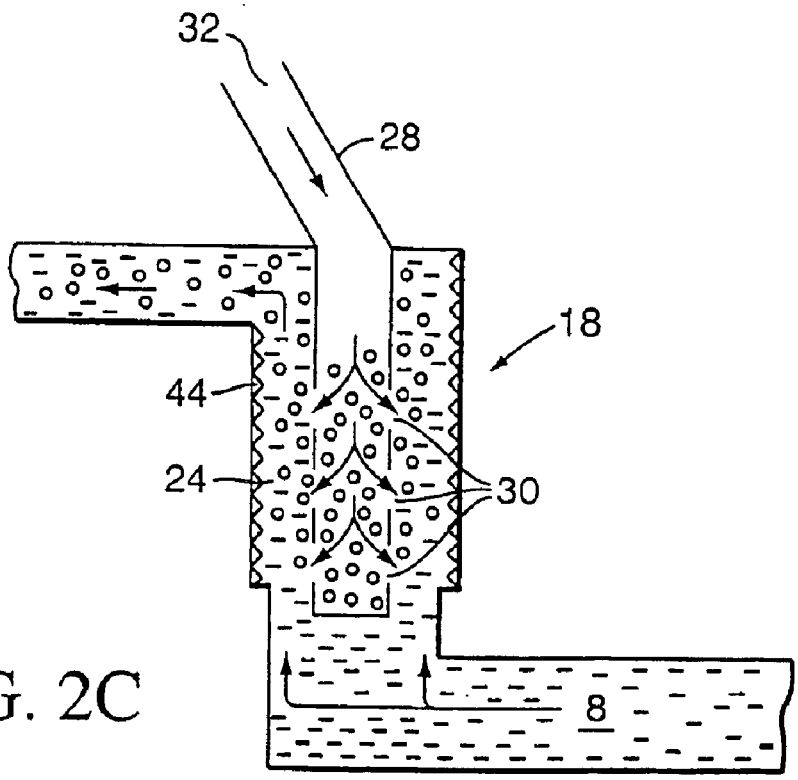
FIG. 2C is yet another alternative to the invention shown in FIG. 2A.

In FIG. 2A, air passes through an intake orifice 32 into an emulsion tube 28. The air well or emulsion tube 28 includes at least one, and preferably several, ports or air bleed holes 30. Fuel 8 flows to the main well from the fuel bowl as described above. The illustration in FIG. 2A shows, in cross-section, a ring, thread or other obstruction 42. The ring or thread 42 is located on the inside wall of the main well relatively downstream of the bleed holes 30 in the air well 28. The ring 42 presents a surface in the path of the air-fuel mixture that causes the mixture to roil, turbulate, tumble and disassociate from the walls of the main well. Thus, the ring 42 acts to improve the amount of emulsification of the air-fuel mixture as compared to smooth-walled surfaces in the prior art device of FIGS. 1 and 1A. FIG. 2B shows an alternative embodiment having a plurality of rings, threads or obstructions 42, 42*a* and 42*b,* in the interior of the main well. The multiple rings more thoroughly emulsify the air-fuel mixture. FIG. 2E discloses another alternative embodiment in which the rings, threads or obstructions 50 are formed on the emulsion tube 28.

In the embodiments shown in FIGS. 2A, 2B and 2E, the rings 42 (or 50 in 2E) are formed as continuous rings on the inner surface of the main well. Of course, one could use partial rings and still obtain increased emulsification relative to the smooth-walled prior art. Likewise, if the main well 18 is not tubular, the rings 42 would conform to the interior shape of the main well. Similarly, in the embodiment of FIG. 2E, different shapes and configurations of the emulsion tube 28 would require that the shape and configuration of the rings 50 also conform thereto. The rings 42 or 50 preferably have well-defined edges to further enhance emulsification.

In still another alternative, the rings 42 or 50 that extend into the interior of the main well 18 can take the form of grooves or threads. Specifically, FIG. 2C shows an alternative embodiment of the invention in which the interior surface of the main well is threaded with a continuous thread 44. The size and spacing of the thread can vary depending on the application. However, even small threads that are widely spaced will improve the degree of emulsification compared to the prior art emulsion systems shown in FIGS. 1 and 1A. By using a thread 44, a plurality of relatively sharp projections can be formed in the interior of the main well relatively easily.

The thread 44 defines a nominal major surface as defined by a line drawn from the tips of adjacent projections. The machined wall surface of the main well 18 defines a nominal minor diameter at the root or base of adjacent threads 44 between the thread projections. Thus, in FIG. 2C the nominal major surface would be the diameter across the well 18 defined at the tips of the thread projections. The nominal minor surface will be the larger diameter of the main well passage at the root or base of adjacent thread projections. This nomenclature also applies to the structures set forth in the remaining figures. The thread 44 presents numerous projections over which the mixture of air and fuel must flow, and therefore acts to maximize the mixture of air and fuel being delivered to the carburetor venturi.

Figure 2D:
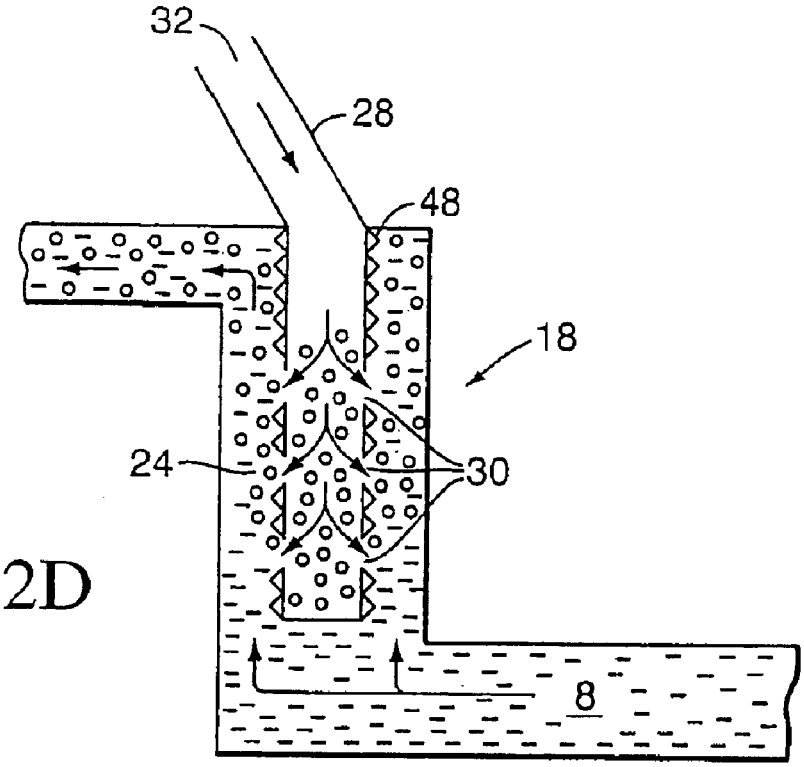
FIG. 2D is another alternative embodiment of the invention shown in FIG. 2A.
Figure 2E:
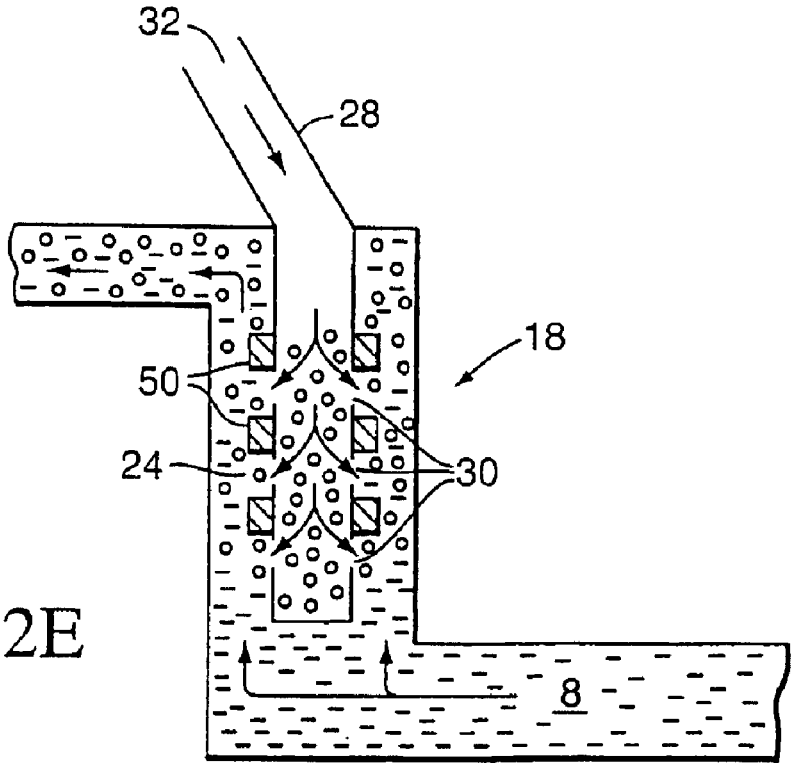
FIG. 2E is an alternative embodiment of the invention shown in FIG. 2A.

FIGS. 2D and 2E show an embodiment of the invention with the threads 48 and rings 50 placed on the exterior surface of the emulsion tube 28 within the well 18. In both of these embodiments the projections 48 and 50 extend outwardly from the wall of the emulsion tube 28 into the path of the air-fuel mixture. By extending into the path of the air-fuel mixture, the air exiting the ports 30 is forced to more thoroughly emulsify the fuel when compared to the smooth-walled emulsion tube shown in FIGS. 1 and 1A.

Though not shown, the embodiments of FIGS. 2A, 2B and 2C can be combined with the embodiments of FIGS. 2D and 2E, incorporating both an emulsion tube 28 with threads, rings or obstructions and a main well 18 with threads, rings or obstructions. In addition, FIGS. 4 and 5, described below, show another embodiment in which a threaded restrictor 36 is employed to further enhance emulsification. It is contemplated that such a restrictor rod could also be used in the FIG. 2 and the FIG. 14 embodiments, for example, by inserting the rod in a spiral fashion between the emulsion tube 28 and the nominal major surface of the main well 18.

FIGS. 14A–E show several alternative embodiments of the invention showing further improvements in fuel delivery and emulsification. In these embodiments various combinations of "bumps" and "dimples" are shown.

Figure 14A:
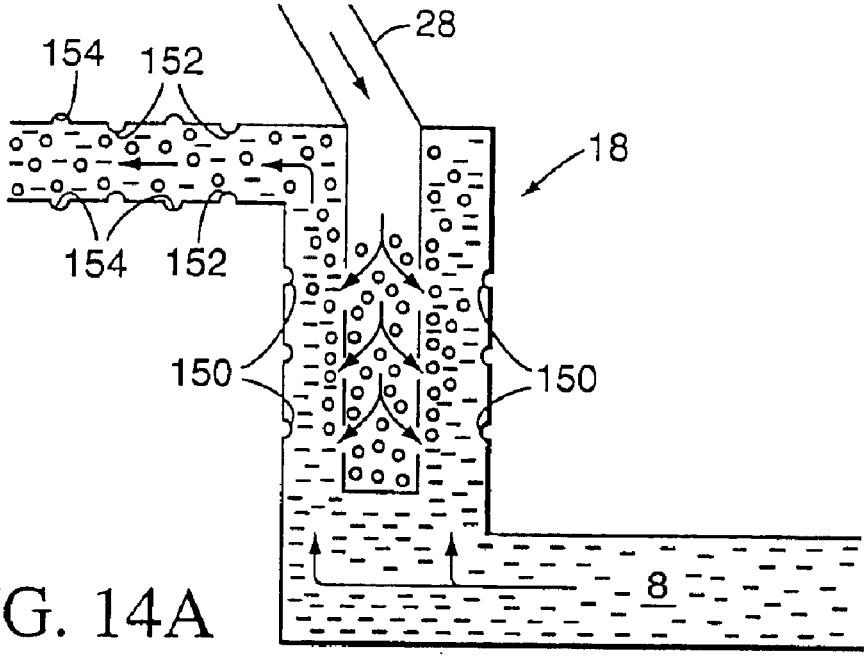
FIG. 14A depicts a sectioned emulsion tube in a fuel well, showing dimples, protrusions, indentations, cavities, and bumps for improved emulsion.
Figure 14B:
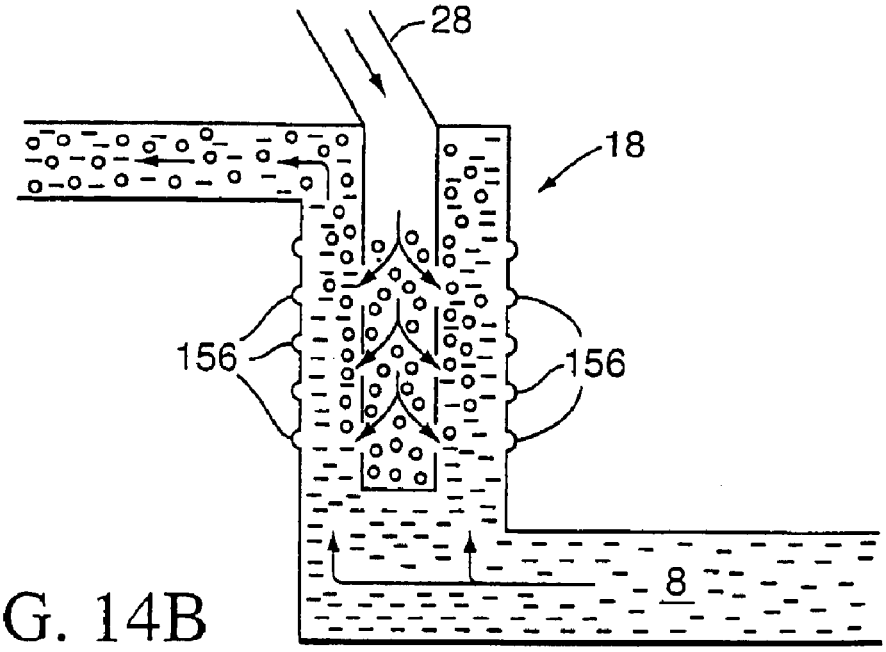
FIG. 14B is an alternative embodiment to the invention shown in FIG. 14A having only cavities in the wall of the fuel well.

In FIG. 14A, projections, protrusions or bumps 150 project from the walls into the main well 18. These obstructions 150 operate in a manner similar to the obstructions in FIGS. 2B and 2C, discussed above, to enhance emulsion of the air in the fuel as it passes through the carburetor. However, further downstream of the emulsion zone is provided another set of projections 152. These additional projections 152 help keep the emulsion state of the air/fuel mixture as homogenous as possible as the fuel/air emulsion passes through the carburetor to the venturi, at which point the emulsion will be mixed with air coming through the throats of the carburetor.

Figure 14C:
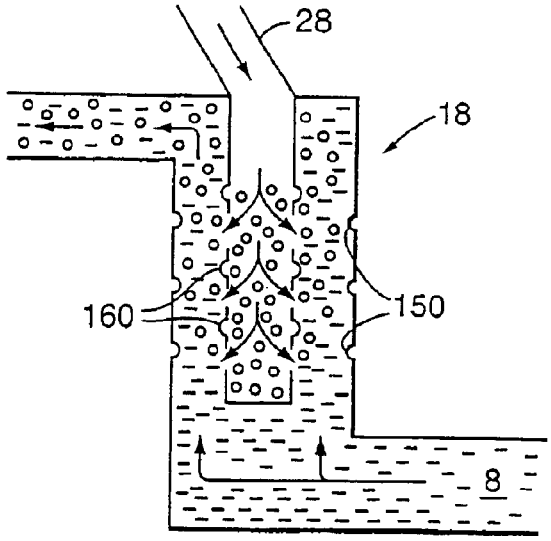
FIG. 14C is an alternative embodiment to the invention shown in FIG. 14A having projections from the wall of the fuel well and projections from the surface of the wall of the emulsion tube.
Figure 14D:
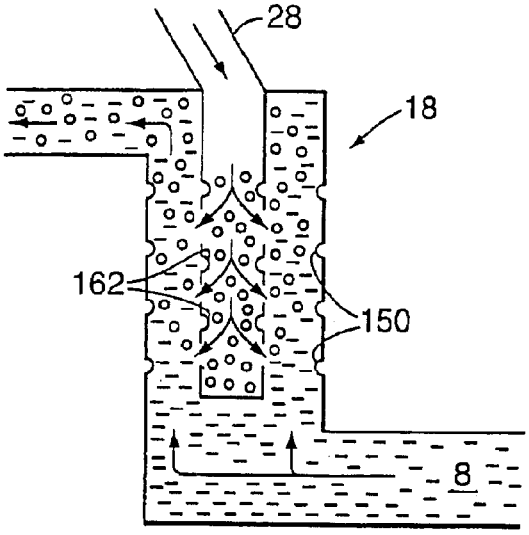
FIG. 14D is an alternative embodiment to the invention shown in FIG. 14A having projections from the wall of the fuel well and cavities in the wall of the emulsion tube.
Figure 14E:
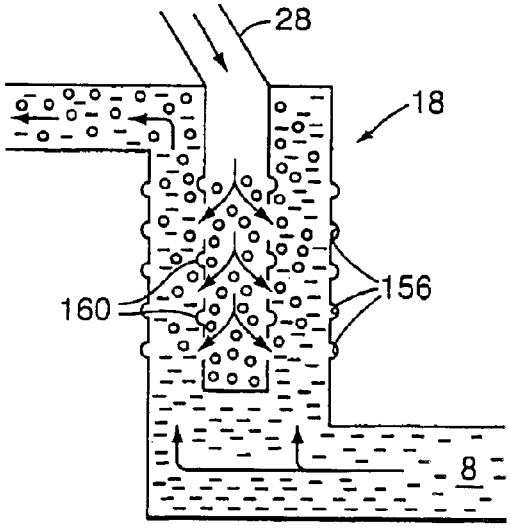
FIG. 14E is an alternative embodiment to the invention shown in FIG. 14A having cavities in the wall of the fuel well and projections from the wall of the emulsion tube.

Also shown in FIG. 14A is a series of cavities, indentations or "dimples" 154 that can, in addition to the projections 152, be formed in any of the fuel delivery passages of the carburetor. In a preferred embodiment the cavities would be formed downstream of the formation of the fuel/air emulsion in the main well 18. These dimples 154 compound the emulsion provided by the projections 152. Other embodiments based on the same principles, in various combinations and permutations are easily determined, some of which are shown in FIGS. 14B–E for example, in FIG. 14B, the walls of the main well have cavities or dimples 156 formed therein. FIG. 14C shows projections such as 150 extending into the main well from its walls, along with projections or bumps 160 projecting outwardly from the wall of the emulsion tube. In FIG. 14D projections 150 extend into the main well from the walls, while the wall of the emulsion tube is provided with cavities or dimples 162. FIG. 14E shows cavities 156 formed in the walls of the main well 18, while the emulsion tube has projections such as 160 extending into the main well.

In each of FIGS. 14A–E, the combinations of projections and indentations act to provide turbulence to enhance both the formation and maintenance of a more complete emulsion over what is currently done.

Figure 3:
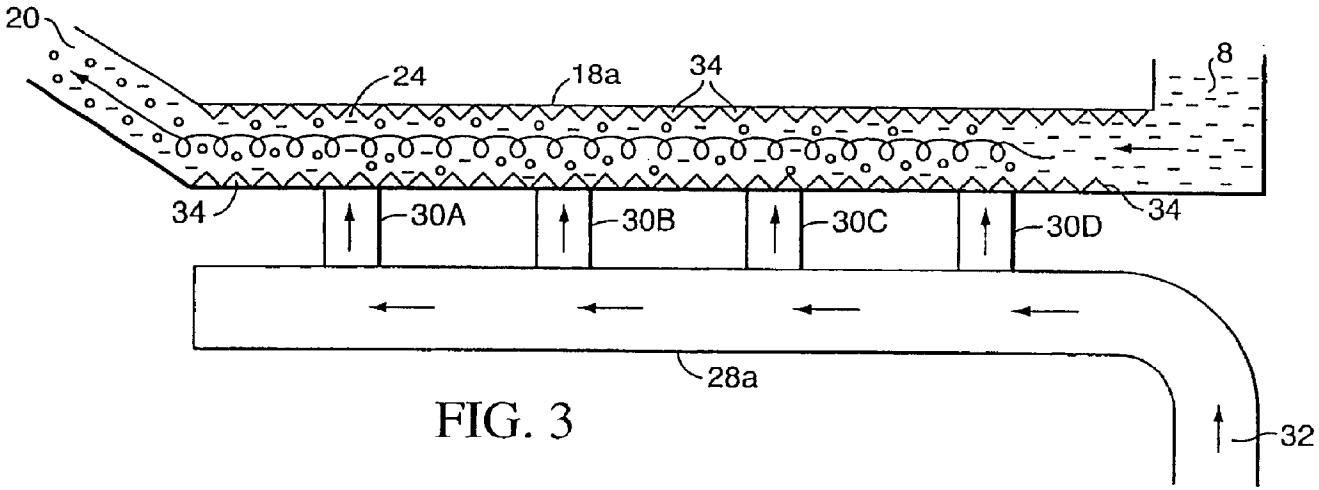
FIG. 3 is a side schematic view of a preferred embodiment of the invention.

FIG. 3 shows a preferred embodiment of the invention having application in other fuel systems. For instance, the principle of operation set forth in FIG. 3 is conceptually similar to the jet engine nozzle set forth in FIGS. 8–10 but not including all the features thereof. The discussion that follows addresses a preferred embodiment of emulsifying air and fuel. However, as discussed above, it is to be understood that other applications also exist. As in the embodiments above, the fuel 8 flows through a fuel well, line or passage 18*a*. Again, the use of the word "well," "line," or "passage," are to be given the broadest possible interpretation.

The fuel well, line or passage 18*a* includes at least one, and preferably a plurality, of obstructions, rings or threads 34. Air is supplied to the well 18*a* from an emulsion tube 28*a* through at least one, and preferably a plurality, of channels or passages 30A–30D. As the fuel flows through the passage 18*a,* air likewise flows through air channels 30A–30D. The air and fuel are thoroughly and homogeneously mixed together due to the turbulence and spiraling action of the mixture induced by the obstructions, rings or threads 34. Indeed, if the threads 34 are placed along a substantial portion of the length of the passage 18*a,* emulsification continues and is enhanced as the air-fuel mixture travels through the passage. The emulsification is still further enhanced by the introduction of air through additional passages 30A, 30B and 30C located downstream of passage 30D. The embodiment of FIG. 3 allows the air and fuel to achieve an increased percentage of air/fuel emulsification before exiting at the discharge nozzle 20 into the venturi zone of a carburetor.

Figure 3A:
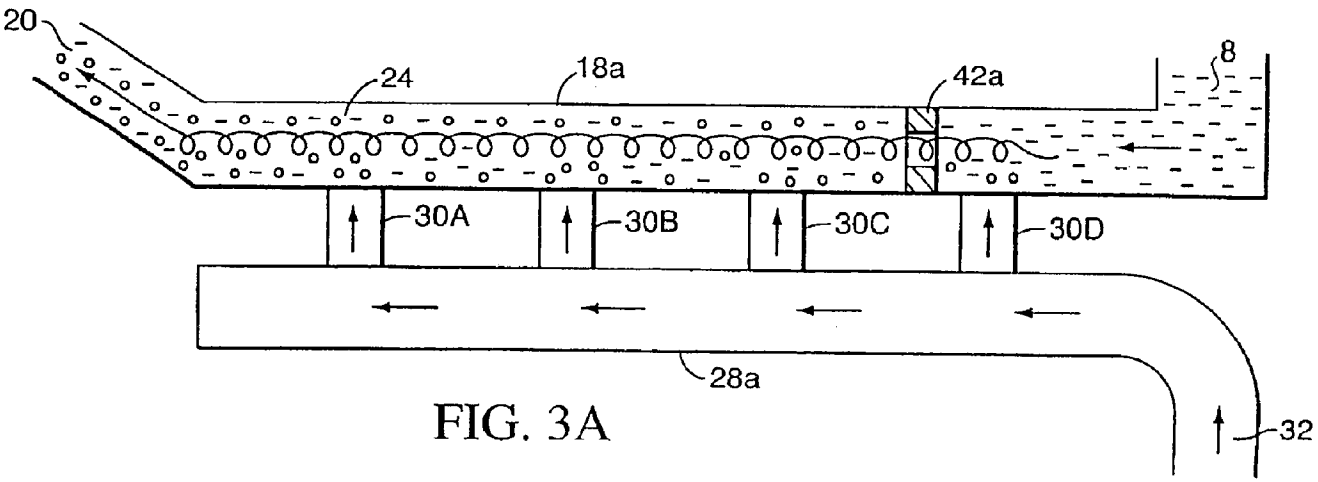
FIG. 3A is an alternative embodiment of the invention shown in FIG. 3.
Figure 3B:
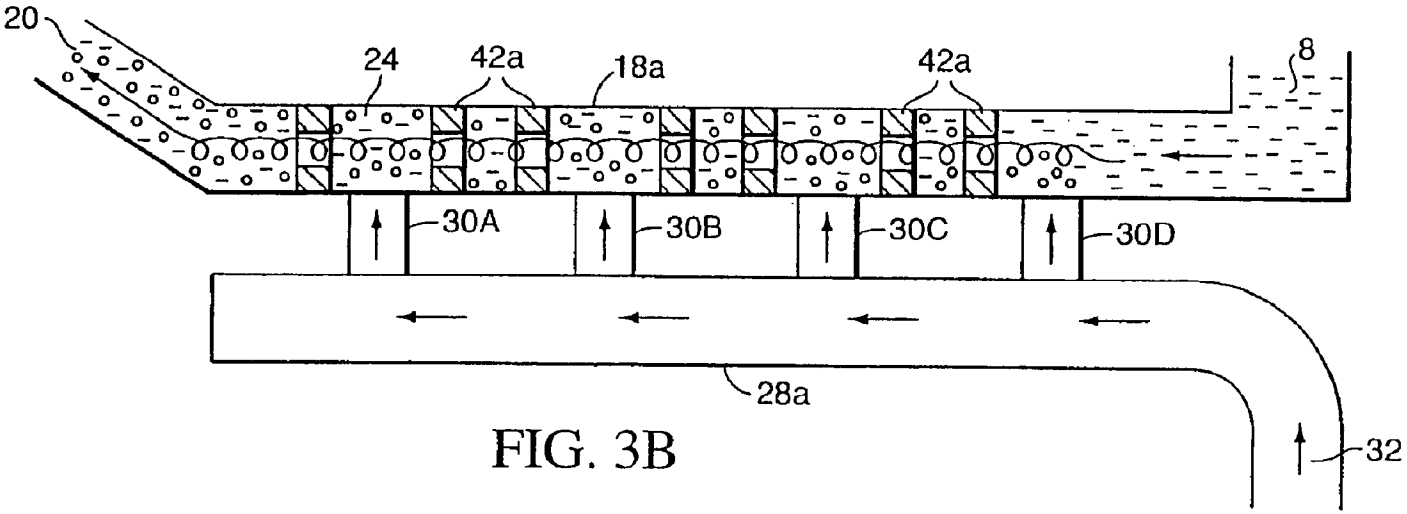
FIG. 3B is another alternative embodiment of the invention shown in FIG. 3.

FIGS. 3A and 3B are further alternatives to the embodiment shown in FIG. 3. In the embodiment of FIG. 3A, only one ring or obstruction 42*a* is employed downstream of the first air inlet 30D. This simple form of the invention will nonetheless result in increased emulsification compared to the prior art. As shown in FIG. 3B, additional rings 42*a* are added downstream of each additional air inlet 30C, 30B and 30A. Each air inlet and ring or obstruction increases the degree of emulsification of the fuel. Again, the rings or obstructions 42 can be circumferentially continuous on the nominal minor surface of the passage 18*a,* or can be discontinuous or "broken" so as not to form a circumferentially continuous ring.

Figure 3C:
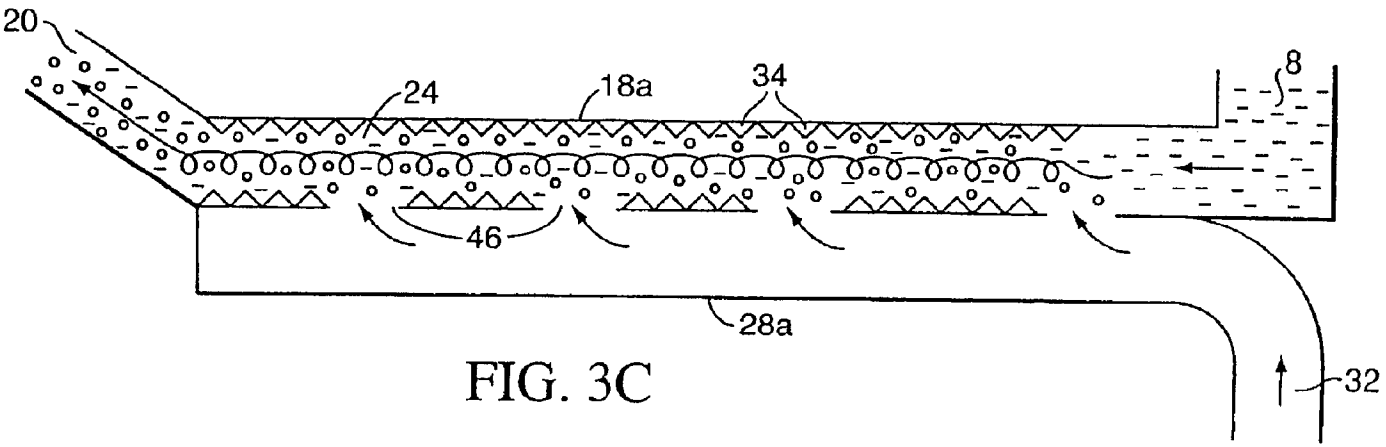
FIG. 3C is another alternative embodiment of the invention shown in FIG. 3.
Figure 3D:
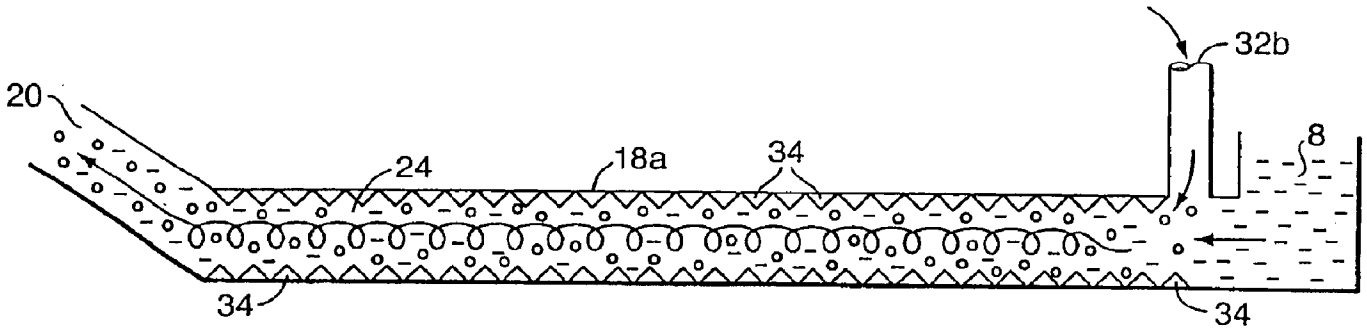
FIG. 3D is a modified version of the invention of FIG. 3.

FIG. 3C shows a further modification to the structure of FIG. 3 in which fuel passage 18*a* and air passage 28*a* are formed or "Siamesed" together. In this embodiment, the air channels 30A–30D are unnecessary, as the ports or air bleeds 46 are simply formed contiguous to both the fuel passage 18*a* an air passage 28*a*. In the embodiment of FIG. 3D, only a single inlet 32*b* is used upstream in the fuel passage 18*a*. Still, even with a single inlet 18*a,* the threads, obstructions or rings 34 will cause the air-fuel to more completely and homogeneously emulsify than in the prior art systems. The tumbling line terminating at the arrowhead at the discharge nozzle 20 is a representation of the roiling, frothing, tumbling path followed by the air-fuel emulsion 24 in the threaded interior of the passage 18*a*.

Figure 4:
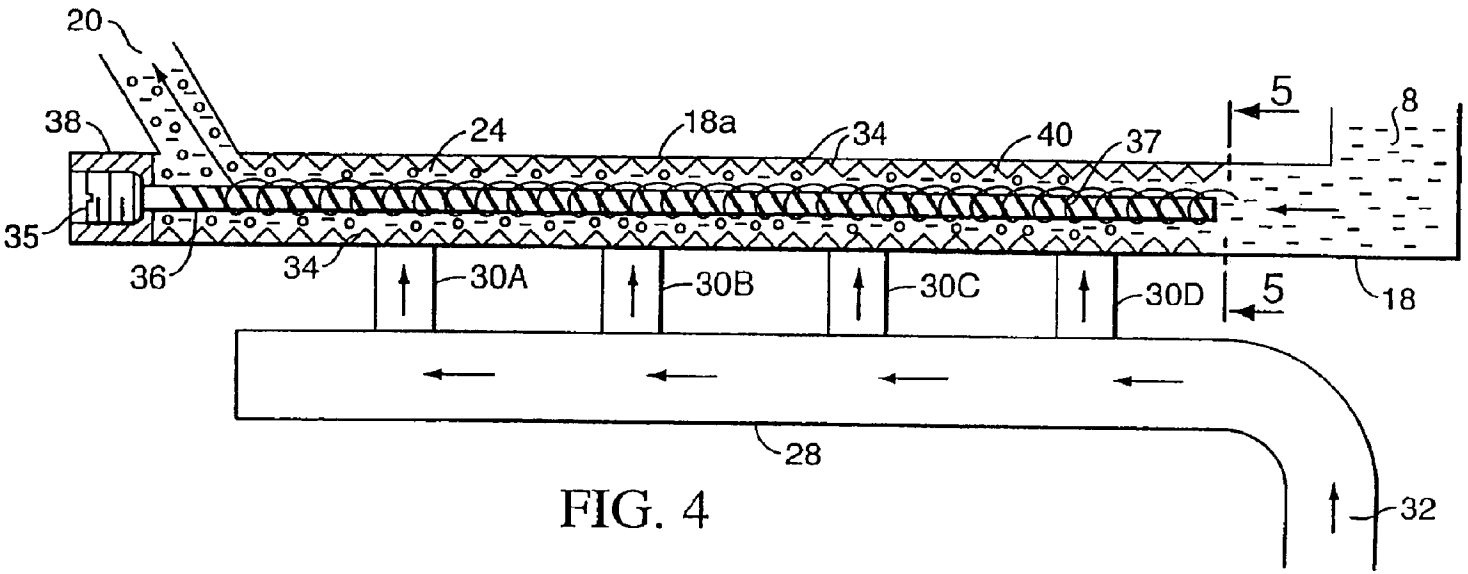
FIG. 4 is a side view of a preferred embodiment of the invention incorporating a restrictor rod.
Figure 5:
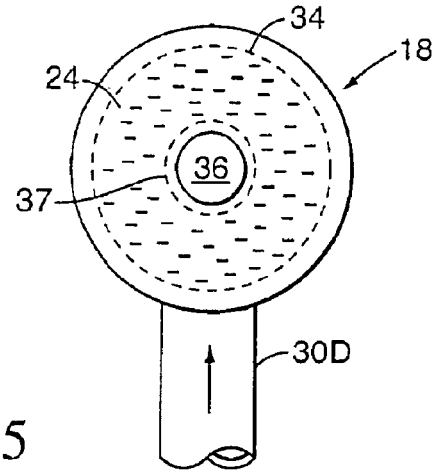
FIG. 5 is a cut away side view taken along line 5—5 of FIG. 4.

FIG. 4 depicts a further modification to the embodiment of FIG. 3. In this modification, a restrictor rod 36 is inserted within the inside of the fuel passage 18*a*. The threaded restrictor rod 36 may be formed or press fit into a setscrew 35, which in turn is threaded into the metering block 38. However, the exact method or form of maintaining the restrictor rod 36 within the fuel passage 18*a* is not material to the invention. The purpose of the restrictor rod 36 is to maintain the air-fuel mixture in closer contact with the threads, rings or obstructions 34 formed in the fuel passage 18*a*. In still another alternative, the restrictor rod itself may have a threaded surface 37 (represented schematically by the diagonal lines in FIG. 4), thereby adding to the degree of emulsification of the air-fuel mixture. For example, FIG. 5 is a cut-away side view taken along line 5—5 of FIG. 4. In FIG. 4, air enters the main well 18 through air channel 30D to combine with fuel 8 to create the emulsified air/fuel mixture 24 within confined passage 40 located between main well threads 34 and restrictor rod threads 37.

The restrictor rod 36 is shown in FIG. 4 as being relatively small in diameter as compared to the available space inboard of the nominal major surface as defined by the projections of the threads. However, the size and cross sectional shape of the rod 36 can vary depending on the application. In a simple form, a small smooth rod centered in the fuel passage 18*a* will restrict the path available to the fuel so that the fuel is in constant proximity with the threads 34 of the passage 18*a*. In another embodiment, the rod 36 could itself be formed as a helix or spiral to induce even more emulsion by both restricting and spiraling the air-fuel mixture.

The various embodiments shown in FIGS. 3 and 4 may be further modified to include the type of projections and cavities, or bumps and dimples, as described above with respect to FIGS. 14A–E. In application to the FIG. 3 embodiments, any combination of bumps and dimples can be incorporated in the structure. With respect to FIG. 4, the projections and indentations can be formed on the restrictor rod, on the passage walls, or on both the rod and on the walls.

Figure 6:
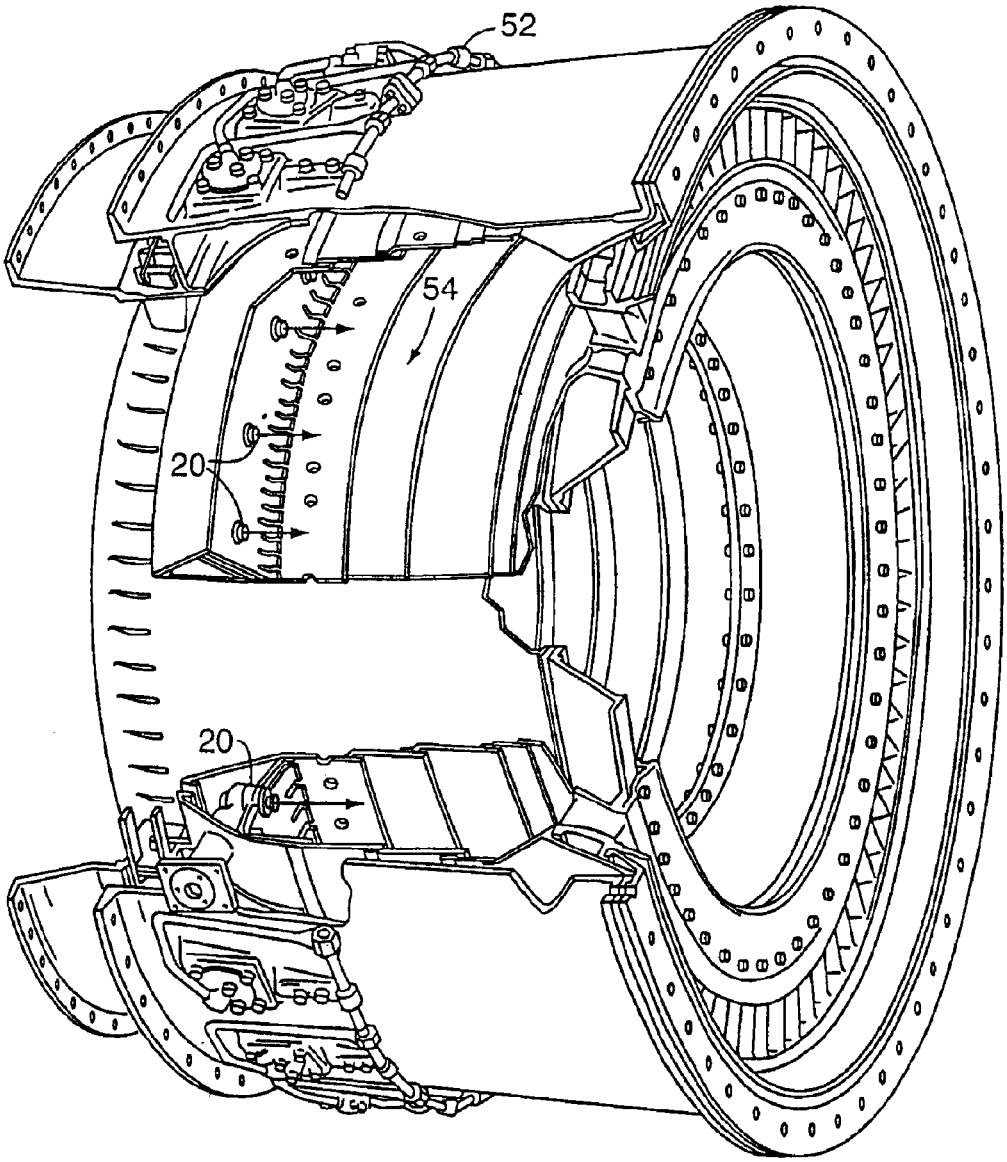
FIG. 6 is a pictorial representation of a jet engine incorporating an alternative embodiment of the invention.

The invention can also be used in other systems where enhanced emulsification is desirable. FIG. 6 depicts one alternative embodiment showing the invention used in a jet engine or turbine. Fuel from a fuel manifold 52, and air from an air passage (not shown), are supplied to a plurality of fuel nozzles 20 by methods similar to those described previously. In accordance with the invention, fuel nozzles 20, fuel manifold 52 or both are designed with ribs, knurls, threads or a restrictor rod such as in FIGS. 2, 3, and 4. This will cause the air-fuel mixture to more completely and homogeneously emulsify before entering the combustion chamber 54.

Figure 7:
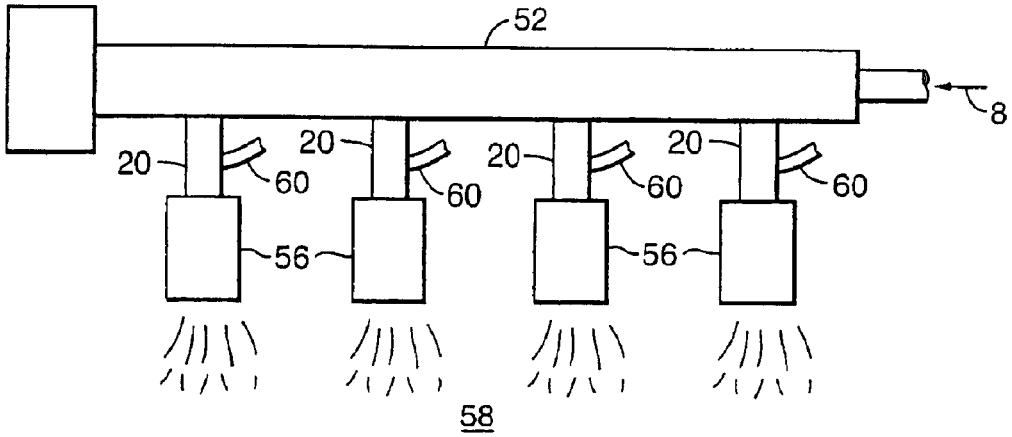
FIG. 7 is a schematic view of an alternative embodiment of the invention in a fuel injection system.

FIG. 7 depicts another alternative embodiment of the invention used in a fuel injection system for an internal combustion engine. Fuel 8 is delivered from a fuel pump (not shown) to the fuel manifold 52. In prior art systems, the fuel injectors 56 are connected directly to the fuel manifold. The injectors 56 deliver fuel into the air entering the combustion area 58 by opening and closing either electronically using a solenoid or mechanically by shifting a needle valve controlled by fuel pressure. To improve the emulsification of the air-fuel mixture prior to entering the combustion area 58, the emulsification improvement systems and methods described above can be employed between the injectors 56 and the fuel manifold 52 in the areas of the nozzle 20. A secondary pressurized air source 60 may be coupled to the nozzle 20 to emulsify the fuel-air mixture by methods described previously. Home heating furnaces or propane torches could also be modified in much the same way so that air and fuel are emulsified at the end of the fuel nozzle prior to combustion.

Figure 8:
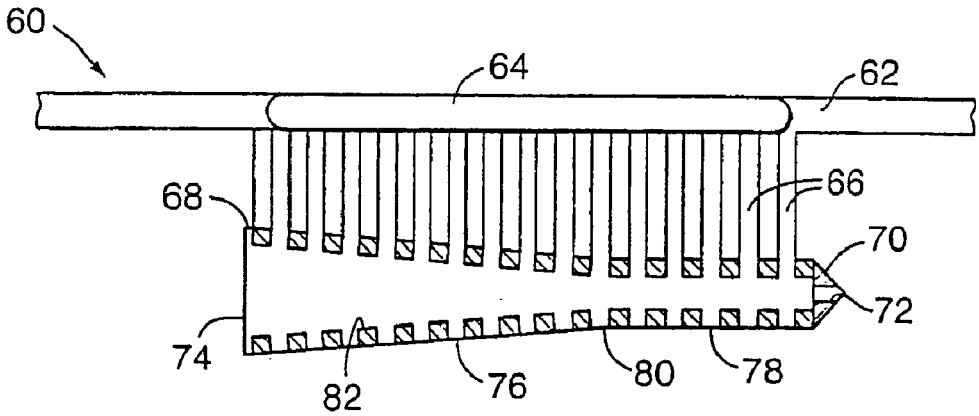
FIG. 8 is a cut away pictorial representative of a fuel nozzle for use in a jet engine.
Figure 10:
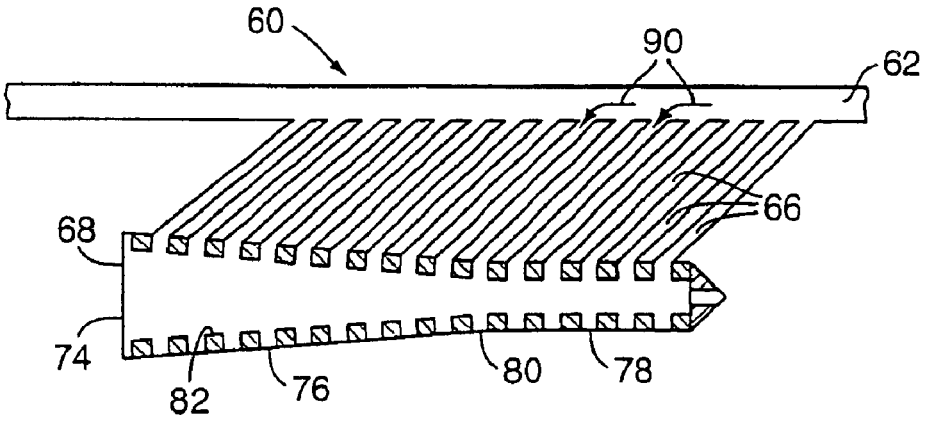
FIG. 10 is a cross-sectional representation of a modified fuel nozzle.

FIGS. 8–10 depict improvements in fuel delivery nozzles for a jet engine. This improved nozzle shown in these figures would replace the nozzle section of the jet engine shown in FIG. 6.

FIG. 8 is a cross sectional view of a schematic or pictorial presentation of a jet engine fuel nozzle shown generally as 60. The nozzle 60 includes a main air delivery port 62. A slidable valve 64 is positioned within main port 62. The position of the slidable valve 64 will open or close air delivery ports 66, a number of which are shown in FIG. 8.

The plurality of air delivery ports 66 lead to a chamber 68 that forms the passage through which the fuel and air mixture flows. The chamber 68 includes a first end 70 having a fuel supply orifice 72. This is the inlet end of the nozzle. The orifice is preferably in the range of 0.027 to 0.040 inches or greater. This is much larger than the typical 0.004 orifice size now used in jet engines. The fuel and air mixture exhausts out the second end 74 of the fuel nozzle 60.

The chamber 68 includes a portion 76 flaring out from the straight portion 78 at, for instance, transition point 80. The interior surface of the chamber 68 is equipped with circumferential rings such as 82 similar to the various forms of rings 42 shown in the other figures discussed above. These circumferential rings perform the same operation as the above-discussed rings. That is, these rings tumble the flow of fuel and air resulting in a fully emulsified mixture being delivered from the port 74 of the nozzle.

The purpose of the slidable valve 64, which could be a barrel valve, for instance, is to uncover greater and greater numbers of air delivery ports 66 as the need for air increases. In FIG. 8 one air delivery port 66 is shown in open communication with the air delivery port 62. As the speed of the aircraft increases, the slidable valve 64 may be moved leftward relative to FIG. 8 to uncover an increasing number of additional air delivery ports 66, thereby providing more air to the chamber 68. As is well known, increases in altitude result in decreases in air density. Therefore, there is a need to increase the amount of air entering the nozzle to manage and control the fuel to air ratio at an optimum level. Consequently, at high altitudes more and more air delivery ports are opened as the host aircraft climbs.

In FIG. 8 the slidable valve 64 is shown. The inventor believes that a barrel valve, preferably a rotary valve style of barrel valve, would be a good choice for an operating valve. Many valve options and choices that are available, as valves for sequentially opening a series of orifices are known. In operation air is supplied to the fuel nozzle generally 60 through main port 62. Main port 62 is capable of flowing a very large volume of air and is metered by the valve 64. The valve 64, which may a slidable valve, other valve types could be used as well, and may be, for instance, a barrel valve that is rotatably openable to provide a range of one port to many ports depending on its rotated location. The barrel valve can also be configured to open certain air intake ports 66 while closing off other ports. For instance, ports at the right side of FIG. 8 can be closed while the barrel valve rotates to open ports in the middle portion of the nozzle 60. Further rotation of the barrel valve could be configured to open even more air inlet ports, in this figure, those at the further left end of the nozzle would be opened while several of the air inlet passages at the right end of the nozzle in FIG. 8, would be opened. Various barrel valve designs, each having engineered opening and closing timing ports are contemplated by the inventor. The design of the ports will depend on the anticipated needs and fuel demands of the system. In circumstances where the host aircraft is operating at high altitude it is necessary to provide a large quantity of air to assure that the oxygen needed for combustion is present. That is accomplished in FIG. 8 by introducing air into the air nozzle at the wider flared part in the middle or wider zone at the left end of the figure. It may be beneficial to close off the air inlet passages at the fuel intake end of the nozzle when the middle or wider zone of air inlet passages are open. At certain air flow rates, for instance, a high air flow rate it is likely that the air inlet passages at the fuel intake end of the nozzle will not be able to handle the increased flow and the air will "back up" at the inlet end of the fuel nozzle. Leaving the air inlet passages at the fuel intake end of the nozzle open may fill the area at the fuel inlet end of the nozzle and build pressure as the flow will not be able to exhaust out the other end of the nozzle rapidly enough. This will result in a "stall" situation where pressurized air will become static in the air delivery inlets. The pressure could build up to high enough pressure to shut off or hinder the supply of fuel coming through the fuel inlet nozzle. To alleviate this situation the interior shape of the main nozzle is modified as is show in FIGS. 9A–C and at the same time using the controlled air supply delivery discussed above.

Figure 9A:
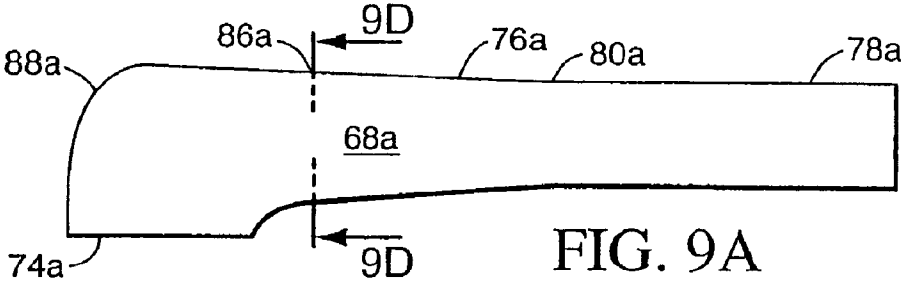
FIG. 9A is a representation of a jet engine/fuel nozzle showing a profile of the interior of the nozzle.
Figure 9B:
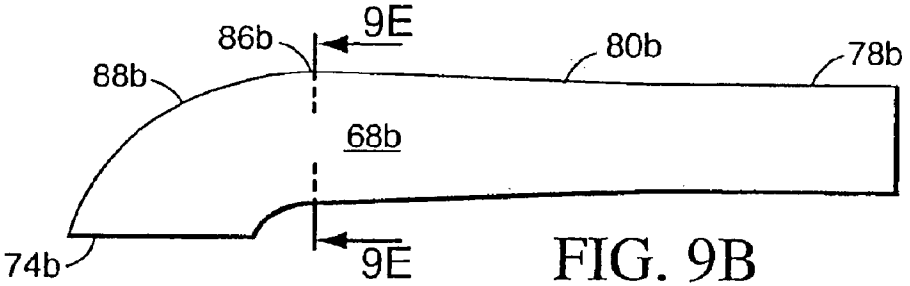
FIG. 9B is a jet engine/fuel nozzle showing an alternative internal profile of the nozzle shown in FIG. 9A.
Figure 9C:
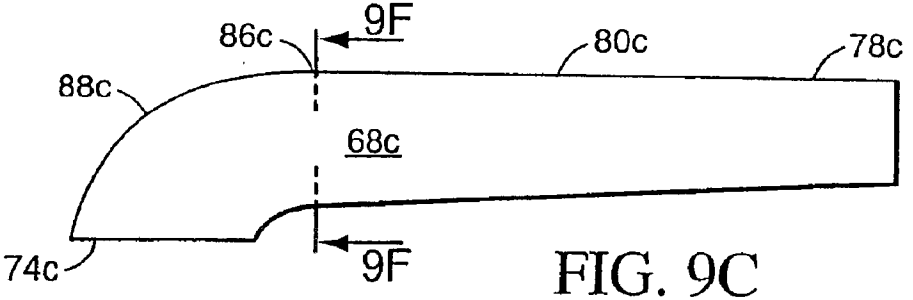
FIG. 9C is a jet engine/fuel nozzle showing an alternative profile of the interior of the nozzle shown in FIG. 9A.

FIGS. 9A–C are presented to show that the valve body or chamber 68 can have at least several different cross sectional shapes. These figures are representative drawings of the interior of the device shown in FIGS. 8 and 10, or alternative shapes thereof. They are presented to show that the interior of the main nozzles can have different shapes of inboard surfaces as defined by the interior of the main nozzles before the installation of the rings or projections such as 82 in FIGS. 8 and 10.

Figure 9D:
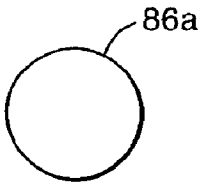
FIG. 9D is a cross-sectional view of the jet engine/fuel nozzle of FIG. 9A through 9D—9D thereof.

For instance, the chamber 68*a* in FIG. 9A has a subtle, but discernable transition point 80*a* wherein the flared portion 76*a* departs from the straight portion 78*a*. The cross sectional shape at region 86*a* of the nozzle of FIG. 9A is generally round, as shown in FIG. 9*d*. A sharp radius bend or curve 88*a* leads to the port 74*a* of the nozzle 68*a*. The shape of nozzle 68*a* may be of greatest utility in aircraft jet engines not requiring the highest altitude or velocity performance.

Figure 9E:
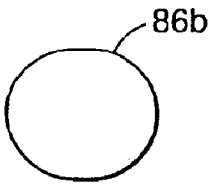
FIG. 9E is a cross-sectional view of the jet engine/fuel nozzle of FIG. 9B through 9E—9E thereof.
Figure 9F:
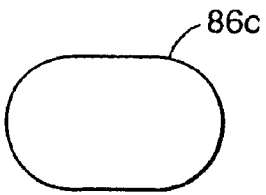
FIG. 9F is a cross-sectional view of the jet engine/fuel nozzle of FIG. 9C through 9F—9F thereof.

FIG. 9B depicts a nozzle or chamber 68*b* that is similar to FIG. 9A, except that transition point 80*b* is less radical than the transition point 80*a* shown in FIG. 9A. In addition, as shown in FIG. 9*e*, the cross sectional shape of the nozzle 68*b* at point 86*b* is somewhat "flattened" in comparison to the circular shape of the nozzle shown in FIG. 9*a*. In addition, in the nozzle of FIG. 9*b*, the bend or curve 88*b* is more gradual, having a larger radius, than the nozzle shown in FIG. 9*a*. This slightly flattened shape shown by FIG. 9*e* and the more gently curved outlet as shown at 88*b* is useful to reduce the back pressure experienced by the main nozzle when the host aircraft is flying at a high altitude and where a moderate to very significant amount of air has to be passed through the nozzle so that there is adequate oxygen to support combustion. FIG. 9C depicts another version or embodiment of the main nozzle, here shown as 68*c*, which would be useful in more high-performance type jet aircraft. In this embodiment, the transition point 80*c* is not perceptible in the nozzle 68*c*. This main nozzle, FIG. 9C, is one that would be used where there is less need for low speed operation, thus a zone of relatively small interior diameter for more than an initial air intake location at the right end, or fuel inlet end, of the main nozzle is not needed. In this embodiment, a more open interior passage is provided that can smoothly increase in diameter throughout the length of the nozzle. No transitional zone at the fuel inlet end of the main nozzle is needed in this embodiment as it would be installed in an environment where more air is needed for sustained high altitude operation and less air/fuel mixture is needed for low altitude or slow speed operation. In addition, in this embodiment, the cross sectional shape at 86*c* is more of an oval as is shown in the cross section FIG. 9*f*. This shape will allow the passage of even more air and fuel out the discharge end of the main nozzle as there is more area for the mixture to pass through as compared to the relatively small cross sectional area shown by FIGS. 9*d* and 9*e*. The nozzles shown in FIGS. 9A–9C are just three examples of the shape of the fuel/air nozzles that are contemplated by the inventor. Other shapes and cross sectional embodiments are possible.

FIG. 10 depicts another embodiment of the fuel/air nozzle shown generally as 60. In this embodiment the main air delivery port 62 is connected to the plurality of air delivery ports such as 66 (the valve 64 in FIG. 8 is not shown in this view but a valve, preferably a barrel valve, would be used to control air flow to the ports 66.) The difference in this structure, as compared to the nozzle shown in FIG. 8, is that the plurality of air delivery ports 66 are angled relatively back from the main air passage 62. This results in a less radical transition of airflow, as depicted by arrows such as 90.

One feature of the improved fuel/air nozzle generally 66 as shown in FIGS. 8–10 is the increased radius or diameter of the flared portion 76. It has been found that the improved air nozzle will create an increase in airflow through the large number of air delivery ports 66. Consequently, if the nozzle was left with a constant diameter along its entire length, pressure will build up in the nozzle sufficient to suffocate the nozzle and/or cause a mixture of fuel and air to "back flow" up through the air delivery ports 66. This is normally detrimental to the controlled metering of air relative to fuel. As discussed above, the inventor has determined that it is beneficial to taper the emulsification nozzle 68 as shown in the figures to alleviate the chance of self-restriction of the nozzle. This could happen if the nozzle were simply a constant diameter tube. By increasing the diameter of the nozzle toward the discharge end 74, the increased volume of fuel and air can be accommodated by the cross sectional area of the nozzle.

It should be pointed out that there are situations where a controlled "back flush" or "back flow" of fuel and/or fuel and air through some of the air delivery ports 66 would be desirable. This could result in increased fuel density entering downstream air delivery ports 66 such that the fuel/air ratio can be increased over what would normally be desirable. This is not a preferred embodiment however. The angle of the air delivery ports 66 in FIG. 10 serve to minimize such back flush action.

In FIGS. 8–10, a plurality of air delivery ports 66 are shown in what appears to be a single plane. That is one embodiment and shown as a simplified form. However, the air delivery ports 66 can be arranged to be radially disposed around the longitudinal centerline of the nozzle to aid in fuel/air emulsification and mixing.

The embodiments shown in FIGS. 8–10 are, in their preferred form, used for jet engines. However, these embodiments are also useful in other applications requiring adjustable fuel emulsification and metering of fuel to accommodate aircraft altitude changes.

In state of the art fuel delivery systems, the small fuel supply orifice (on the order of 0.004 inches) requires a high pressure (on the order of 300 psi) to force the fuel through the small orifices. This high pressure is believed to cause the fuel to separate into fine droplets as it enters the jet engine combustion chamber. The fuel will, however, coagulate quickly due to a vacuum existing between the droplets that are separated. When the fuel coagulates it is less emulsified with the supplied air, and thus, the emulsification process enabled by this invention is advantageous. The coagulation effect, indicating a less emulsified fuel and air mixture, can be observed in the "fringes of flame" exhibited by a jet engine running near its peak performance level.

Another aspect of this invention harnesses the natural frequency of fuel to improve emulsification. Fuels of a given specific gravity will have a natural frequency. The size and spacing of the rings 82 of the FIGS. 8–10 embodiments can be arranged to excite the fuel to its natural frequency. At its natural frequency, the fuel will be more easily broken into droplets, therefore exposing the maximum surface area possible to be surrounded by oxygen for combustion.

The nozzle of FIGS. 8–10 can increase fuel efficiency in jet aircraft by at least 15%. Similar enhancement for carburetors is about 5%, and for fuel injection systems is about 12%.

Numerous other modifications and features can be selected from each of the embodiments described above and combined to optimize emulsification of the air-fuel mixture to each application. For example, the size and number of air channels 30*a*–30*d* (see FIGS. 1–5) can be altered. Likewise, the diameter of the restrictor rod or tube 36 (see FIGS. 4 and 5) and the pitch, lead, thread angles and size of threads or obstructions on the restrictor rod 36 or in the main well 18 can be changed. Thus, the invention comprises a system and method for more thoroughly emulsifying two fluids than was previously capable with the prior art. A first fluid travels through a primary fluid passage. A second fluid is introduced through an inlet to the main fluid passage. At least one interior surface within the primary passage is formed with at least one obstruction thereon at a location downstream relative to the inlet for the second fluid, and causes the two fluids to more thoroughly mix and emulsify.

Figure 11:
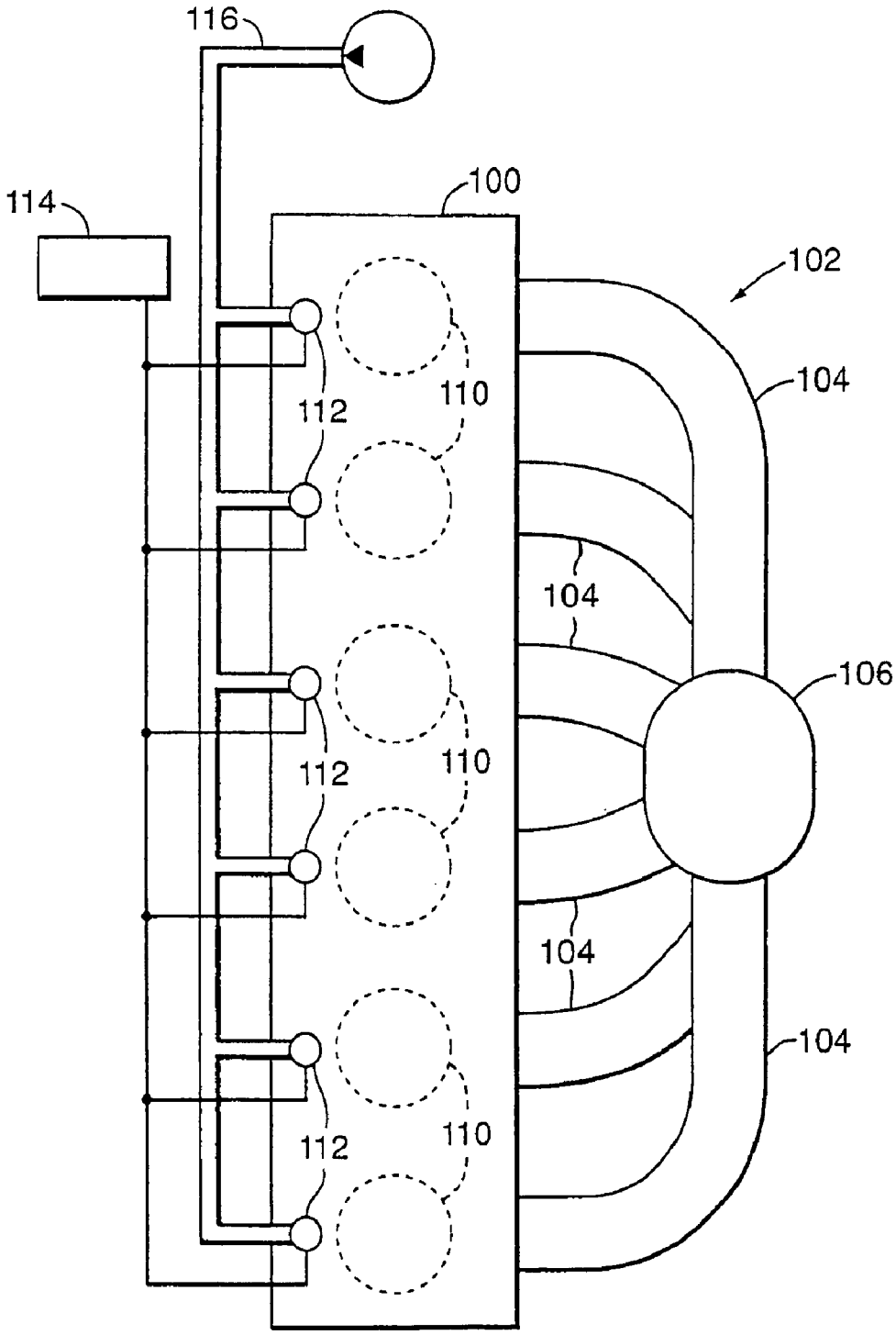
FIG. 11 PRIOR ART
FIG. 11 depicts a graphical representation of a prior art fuel-injected engine.
Figure 12:
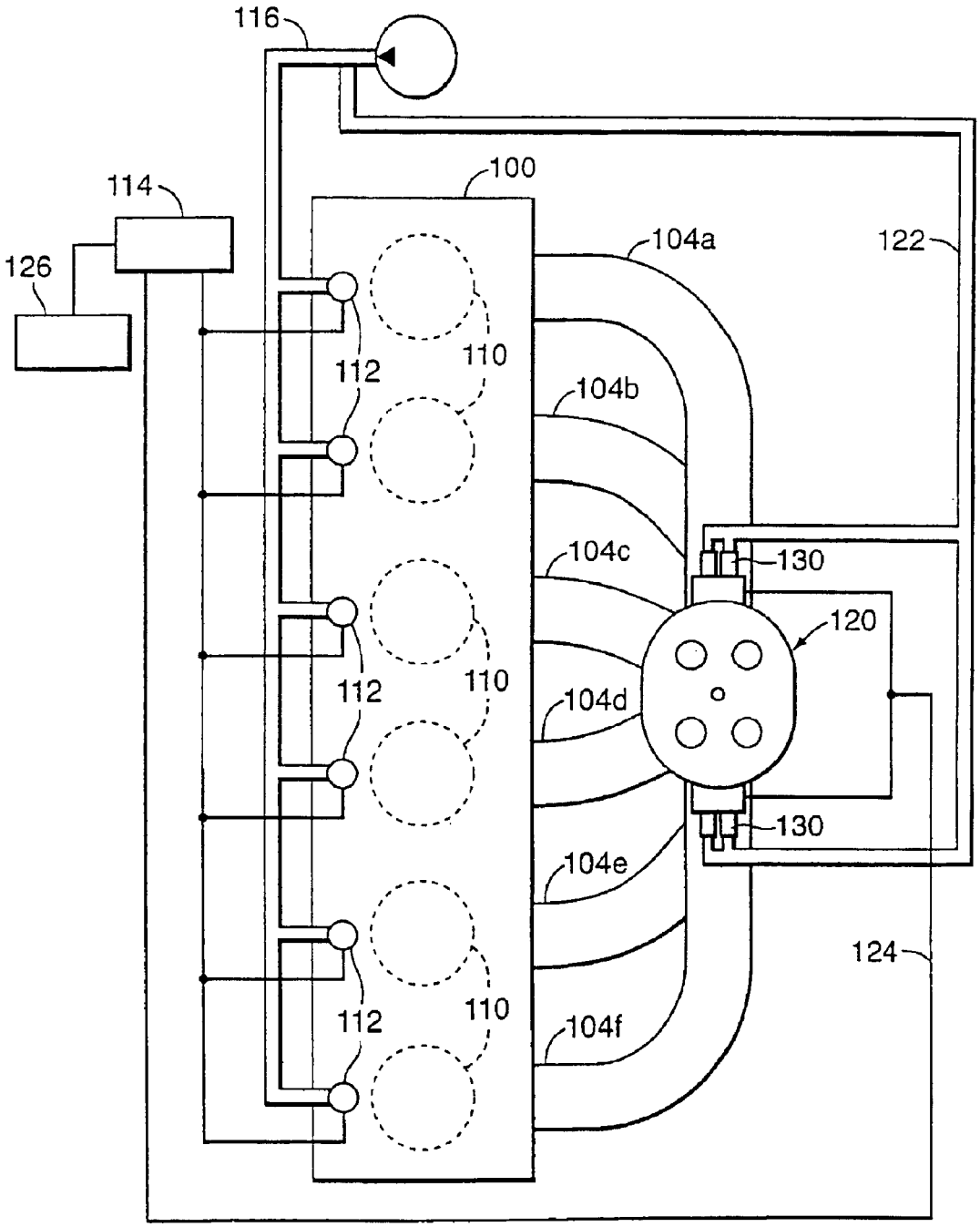
FIG. 12 depicts a graphical representation of air and fuel delivery system for use on a fuel-injected engine.
Figure 13:
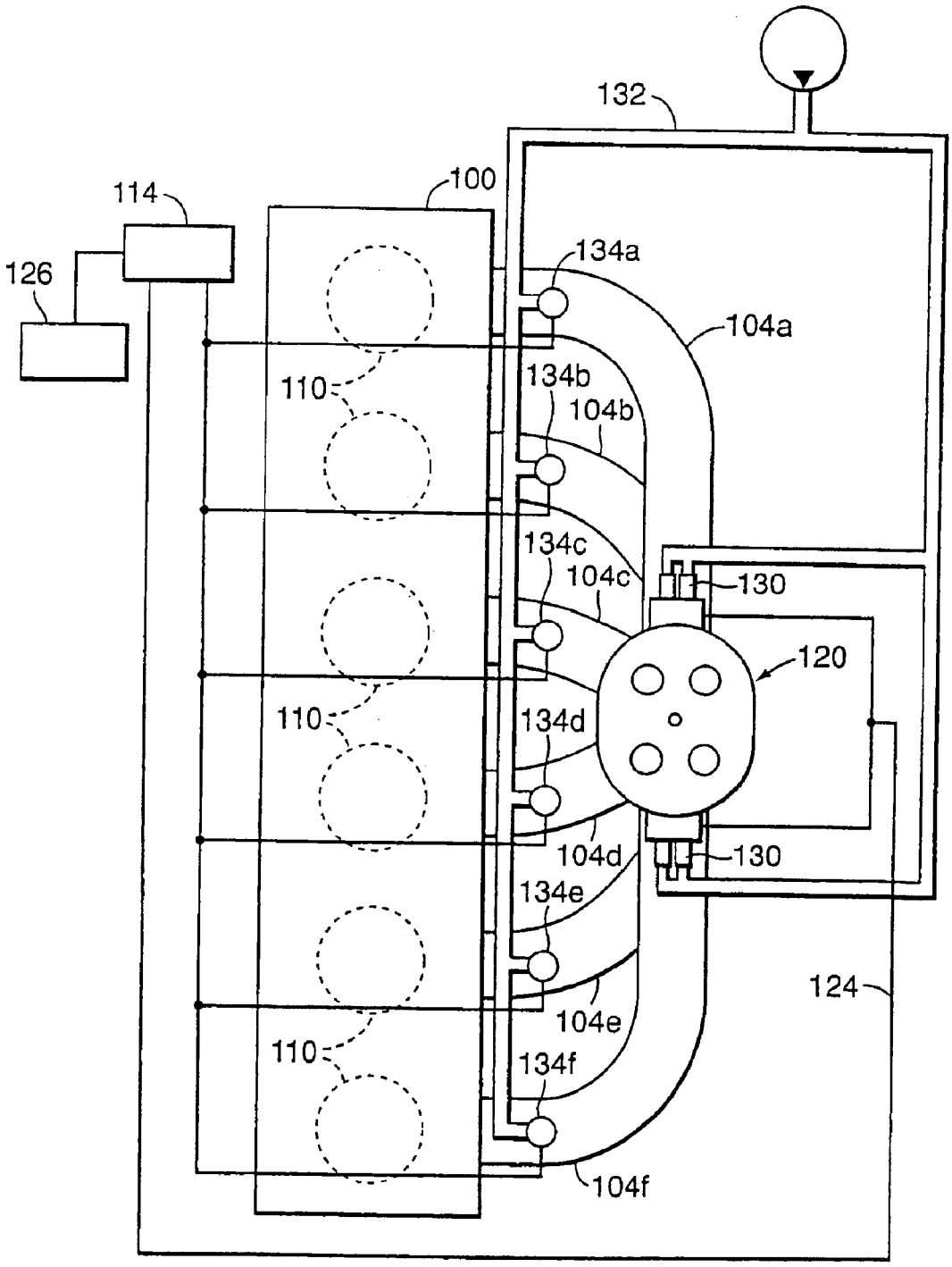
FIG. 13 depicts another graphical representation of an embodiment of the fuel emulsification system for use on fuel-injected engines.

It has also been determined that the systems and methods for emulsifying fuel as described above in connection with FIGS. 1–10 are also applicable to emulsify fuel in a fuel injected engine. FIGS. 11–13, discussed below, depict systems and methods of providing an emulsified fuel load to the combustion chambers of the engine.

FIG. 11 is a schematic pictorial representation of the known elements of a fuel-injected engine. Operations of conventional fuel injection systems of this type is well known in the art, and are described only generally here. For more detailed discussion of the operation of fuel injected engines, see *The Haynes Fuel Injection Manual* by Don Pfeil and John H. Haynes, published by Haynes North America, Inc. Newbury Park, Calif., incorporated herein by reference.

In FIG. 11, an engine block 100 is shown in the form of standard six-cylinder engine. The inventions described here (and above) are equally applicable to single cylinder engines. An intake manifold, shown generally as 102, includes air intake runners 104 that lead from an air valve 106 to the combustion chambers 110. Six fuel injectors 112 (one for each cylinder) provide the source of fuel to the engine. An electronic control unit ("ECU") is shown generally at block 114, and will control various aspects of the motor operation, including timing of fuel delivery through the injectors 112 and the spark (not shown) to the combustion chambers. The control unit 114 will sequentially, or in a predetermined timing pattern, allow fuel to flow from the high pressure fuel delivery system 116 through the injectors 112 to the combustion chambers 110, where the air and fuel mixture is ignited.

Referring now to FIG. 12, and in accordance with the invention, an electronic carburetor, shown generally 120, is shown in place of the air valve 106 of FIG. 11. A fuel supply line 122 supplies fuel to the electronic carburetor 120. The electronic carburetor 120 includes emulsification techniques described above to thoroughly emulsify the air and fuel, and supplements the delivery of fuel to the combustion chamber from the injectors 112. The ECU 114 controls the electronic carburetor 120 and at least one injector 130 to meter the amount of air and fuel delivered to the combustion chamber 110. Electrical conduit 124 allows communication between the electronic carburetor 120 and injectors 130 and the ECU 114.

In this embodiment, the ECU 114 determines the amount of fuel needed by the engine. The ECU 114 will monitor various inputs (shown generally as block 126), such as throttle position, engine control information, performance sensors such as an $O_2$ sensor, and other sensors as is well known in the industry to optimize engine performance. The ECU 114 determines the amount of fuel to be delivered by the high-pressure fuel system 116 through the injectors 112 and the amount of air and fuel to be delivered through the electronic carburetor 120. The electronic carburetor 120 does not have float bowls as are used on non-electronic carburetors, but instead, uses injector heads such as 130 that are electronically controlled by the ECU 114 to release fluid The electronic carburetor 120 includes the emulsification systems and methods described above in connection with FIGS. 1–5 to more thoroughly and homogeneously mix the air and fuel. Indeed, in the prior art system shown in FIG. 11, the fuel is injected through injectors 112 directly into the combustion chamber 110, where it mixes with the air delivered to the combustion chamber through conventional intake manifold systems. In contrast, by adding the electronic carburetor 120 employing the emulsification techniques of FIGS. 1–5, as shown in FIG. 12, an auxiliary charge of more thoroughly emulsified air and fuel can be introduced to the combustion chamber through the intake runners, such as the elements identified as 104*a–f* when such is determined to be necessary by the ECU 112. Moreover, the emulsification techniques shown in FIGS. 1–5 above can be employed not only in the carburetor, but in the intake runners 104*a*–104*f* as well. In that manner, the obstructions placed in the intake runners can continue to emulsify the fuel as it passes from the carburetor to the combustion chamber.

Thus, use of the emulsification techniques in FIGS. 1–5 with the electronic carburetor 120, or with the intake runners 104, or in combination with both, results in greater emulsification of the fuel and air in comparison to the fuel supplied through the injectors such as 112. Therefore, if some portion of the fuel is delivered through the electronic carburetor 120, the overall fuel efficiency of the engine will increase, resulting in better overall fuel economy and a decrease in particulate emissions of the engine.

More specifically, the ECU 114 is programmed to monitor all performance parameters of the engine, and optimizes the proportion of fuel and air desired to be delivered by the electronic carburetor 120 relative to the amount of fuel to be delivered by the injectors 112. In normal driving situations, such as when cruising at a constant speed over level terrain, the bulk of fuel delivery will come in a highly emulsified form from the electronic carburetor 120 through the intake runners 104. However, at some load conditions, such as high torque requirements, the ECU 114 will direct additional injection of fuel into the combustion chambers via injectors 112. At the same time, the ECU will adjust timing and other parameters as is well known in the art to accommodate the increased fuel charge. In a preferred embodiment, about seventy percent of the fuel will come in a highly emulsified form through the carburetor 120, while the injectors 112 deliver about thirty percent of the needed fuel. However, these ranges can be much broader or more narrow in actual practice—generally at or under the control of the ECU as programmed for the specific engine and driving conditions.

Another embodiment of the invention is shown in FIG. 13. In this embodiment, the electronic carburetor 120, the ECU 114 and its inputs 126 are the same as in FIG. 12. Fuel delivery to the carburetor is likewise similar. However, the fuel injectors 112 shown in FIGS. 11 and 12 are replaced with injectors 134*a*–134*f* located in the runners 104*a*–104*f*, respectively. The injectors 134*a*–134*f* are controlled by the ECU 114. In this embodiment, fuel is not injected directly into the combustion chambers 110, but instead, is injected into the manifold intake runners 104*a–f*. Again, by fitting the intake runners 104*a*–104*f* with the emulsification techniques of the present invention, overall efficiency of the engine can be increased by injecting a fully emulsified fuel charge to the combustion chamber 110.

Figure 15:
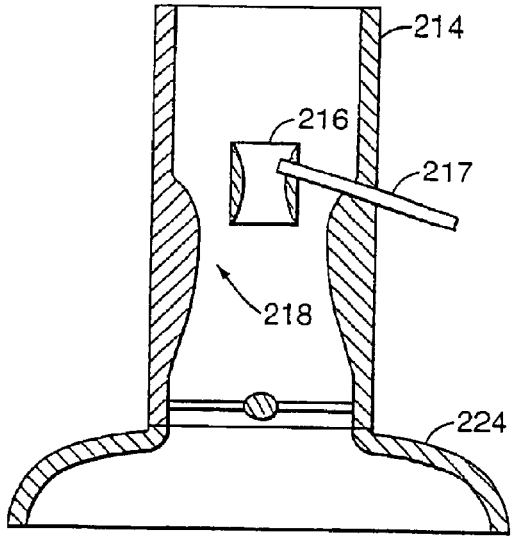
FIG. 15 PRIOR ART
FIG. 15 is a cross section view of a prior art carburetor throat showing the location of the venturi booster above the venturi of the carburetor.

FIG. 15, labeled "Prior Art," depicts a simplified and schematic representation of the throat section of conventional carburetor 214, mounted on a manifold 224, where the booster venturi 216 is located generally above the venturi section, generally 218, of the carburetor. The venturi section, which is the smallest inside diameter of the carburetor throat, is known as the "mean area" or "mean" of the carburetor throat. The purpose of the booster 216 and venturi 218 are well known to those of ordinary skill in the art. Generally, there is a pressure differential between the air at atmospheric pressure at the intake of the carburetor throat and the air pressure in the intake manifold and the carburetor throat when the host engine is running. This pressure differential is used to deliver fuel into the low-pressure area, the mean area, of the carburetor throat. Normally a carburetor receives fuel from a float bowl. The float bowl is filled with fuel and includes a fitting, orifice, passage or the like that allows atmospheric pressure to access the interior of the float bowl. The atmospheric pressure in the float bowl is equal to the atmospheric pressure at the intake of the carburetor throat unless there is a pressure-increasing element associated with the carburetor throat. A pressure increasing element is, but is not limited to, a forced air system such as a hood scoop, NACA duct, or other air flow inducing or airstream directing system. The pressure-increasing element could, as another example, be a pressurizing pump, such as a supercharger, turbocharger or similar flow-increasing device.

A pressure differential is also induced by means of a venturi in the throat of the carburetor. The venturi is a restricted section of the diameter of the carburetor throat that creates a low-pressure area downstream of the restriction. Conventional carburetors have a main fuel delivery port upstream of the venturi or mean. Fuel is delivered by the fuel delivery tube with delivery resulting from the low pressure in the mean area, relative to the higher pressure in the float bowl at atmospheric, created by the venturi.

It is well known to use a booster venturi in a carburetor to enhance the signal, and provide for fuel volume delivery relative to demand as controlled by a throttle plate. The booster venturi includes a venturi portion in a relatively small diameter tube carried in the throat of the carburetor. As air passes through this small diameter tube and through the venturi section thereof fuel is drawn into the booster venturi and delivered out the downstream section thereof. The fuel-air mixture will then pass through the venturi section of the carburetor. A complete description of carburetor function is shown and clearly described in *The Haynes Holley Carburetor Manual* by Mark Ryan and John H. Haynes, published by Haynes North America, Newbury Park, Calif. (1993) herein incorporated by reference.

The inventor has found, however, that performance of the carburetor, in certain circumstances, particularly when the pressure at the entrance to the carburetor throat is higher than atmospheric pressure, is improved by locating the main fuel delivery port below the venturi of the carburetor. Normally, where the inlet pressure is greater than ambient and greater than the pressure on the float bowl and the fuel therein (normally at ambient pressure) there will be a decrease of fuel delivery. This is due to the higher pressure in the portion of the carburetor above the venturi (where the fuel supply inlet is in a conventional carburetor) acting on the fuel delivery port.

Figure 16:
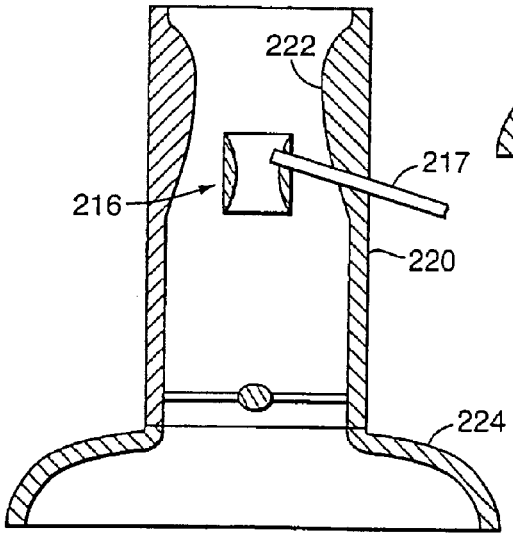
FIG. 16 is a cross section view of a carburetor throat showing relocation of the booster below the venturi of the carburetor.

The improvement in fuel delivery in those situations where there is greater than ambient pressure at the inlet to the carburetor is realized when the main fuel inlet is located below the venturi. FIG. 16 shows an embodiment of an improved carburetor where the main fuel supply enters the carburetor downstream of the venturi. In this embodiment, the venturi booster 216 is below the venturi and the fuel entry port is the end of supply conduit 217. In an alternative embodiment no booster venturi used. The fuel supply port is simply provided at a point at or below the venturi. These two carburetor embodiments operate as follows. First, there is assumed to be positive pressure (that is, pressure greater than atmospheric) at the inlet of the carburetor. This is the result of a flow-inducing device such as a scoop or air pump. In FIG. 15 such a pressure level above the venturi and for that matter, above the booster, would overcome the atmospheric pressure at the float bowl and thus there would be no pressure differential between the float bowl and the venturi. Thus, fuel that needs to be delivered from port 217 (in FIG. 15) backs up in the port 217 and is not delivered through the carburetor. However, by relocating the booster venturi to a position below the main venturi as shown in FIG. 16, there is no "stalling" and there will be increased fuel delivery to the port 217 and into the engine. This is possible because the higher pressure air above the mean is forced to pass through the venturi and thus the pressure just below the venturi will be reduced sufficiently to enable the delivery of fuel from the delivery port 217. The delivery port will see atmospheric pressure from the float bowl and, with proper design, the venturi will provide a lower than atmospheric pressure zone such that the fuel is delivered from the port 217 into the throat of the carburetor.

FIG. 16 shows the fuel delivery port 217 associated with a booster venturi. As stated above, the main fuel delivery need not be through a booster but can be an alternative embodiment, such as a simple port in the sidewall of the carburetor body leading into the throat of the carburetor.

"Tuning" of carburetors under different conditions can result in greater overall engine performance. For example, under some types of driving condition, it is desirable to have more torque, while in other cases it may be desirable to have high horsepower. In addition, different cam, valve and compression characteristics of an engine may require different placement of the venturi 222 relative to the booster 216 (FIG. 16). The optimal location of the venturi 222 above the booster 216 is determined through testing and research.

Figure 17:
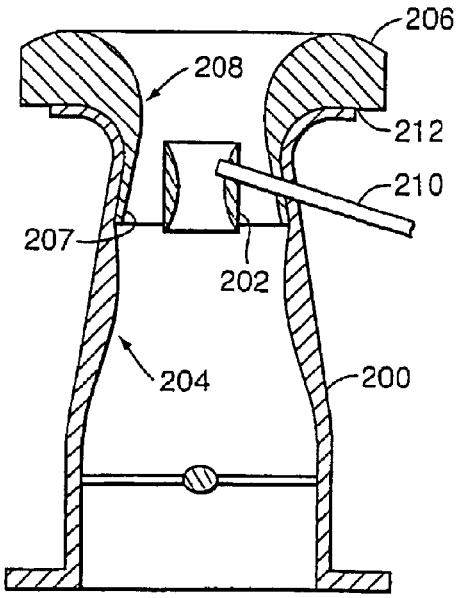
FIG. 17 depicts a cross section view of a flow inducing attachment similar to that of FIG. 18 located on a carburetor.

In order to accommodate such testing and research, it would be advantageous to have the ability to change the location of the venturi above the booster without having to recast or machine the throat of the carburetor. This may be particularly useful in high-performance environments, such as the testing and running of racing or other high performance vehicles. Referring now to FIG. 17, an insert 206, has a cross-section shape that is substantially like an air horn as is sometimes used at the intake of a carburetor. That is, the insert has a toroidal upper portion 208 and a lower portion 207 that fits into the throat of a standard carburetor shown pictorially as 200. (An airhorn normally does not fit into the throat but is usually bolted to the top surface of the carburetor throat.) The upper portion 208 of the insert 206 creates a smaller inner diameter opening, the venturi, above the booster 202, forming a venturi above the booster venturi 202. The lower portion 207 of the insert 206 is formed to extend to a location above the original venturi 204, essentially blending in with the cross-sectional diameter of the throat of the carburetor to eliminate or minimize the original venturi area 204. Thus, the insert 206 is dimensioned such that there is a smooth transition from the walls of the insert 206 to the walls of the carburetor throat at the venturi 204, thereby eliminating or minimizing the effect of the original venturi 204. At the same time, the insert 206 forms, at region 208, a new venturi or mean area above the booster 202. This places the new venturi as supplied by the insert, in a beneficial location for fuel delivery in pressurized systems as is discussed above in connection with FIG. 16.

The exact location of the new venturi region 208 above the venturi booster, along with its particular shape and dimensions, and as well the transition or degree to which the original venturi 204 is eliminated, will be determined in accordance with testing under various conditions. Ideally, a plurality of inserts 206 are made as a set and the set is carried by the engine tuner to the engine test site. The engine tuner can then simply optimize the carburetor by "swapping" the inserts, such as 206, in and out of place on the carburetor without replacing the carburetor.

It is also possible to locate an insert having a fixed venturi section relatively outwardly from the booster location by spacing it upwardly from the margin 212 (referring to FIG. 17) by use of a spacer ring or other distance piece (not shown). Such a spacer need not be a solid or static piece, but could be an adjustable device that could automatically adjust the vertical distance between the venturi booster and the mean area of the insert. Such adjustment could be hydraulic, electrically driven or operated via vacuum or air pressure.

In addition to changing the location of the venturi relative to the booster in a carburetor, further improvements in performance can be obtained by optimizing other dimensional characteristics of a carburetor for given conditions or engine parameters. Again, this is frequently viewed as advantageous in high-performance environments, where weather and engine characteristics change frequently.

Figure 19:
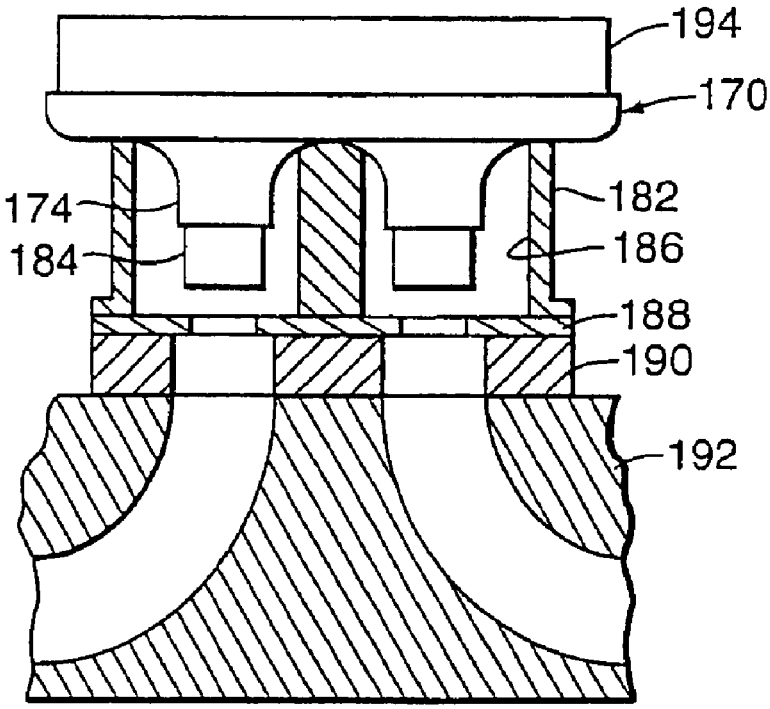
FIG. 19 is a cross sectional view depicting a flow inducing attachment that fits into a throat or multiple throats of a carburetor and relocates the venturi relative to the booster.

For example, it is often the case that a carburetor used with an engine is slightly "oversized" for requirements of the engine. This may occur where the one size carburetor is too small, but the next largest available carburetor is too big. In that case, one usually selects the larger carburetor. This situation also occurs in automobile racing, where sanctioning bodies often require "restrictors" to be placed between the carburetor and the intake manifold. Such a restrictor 188 is shown in FIG. 19. As shown in this figure, a restrictor 188 effectively reduces or "restricts" the diameter of the carburetor throats to the intake manifold 192. With a restrictor 188 between a carburetor and an intake manifold on an engine, a previously optimized carburetor is no longer optimal.

Figure 18:
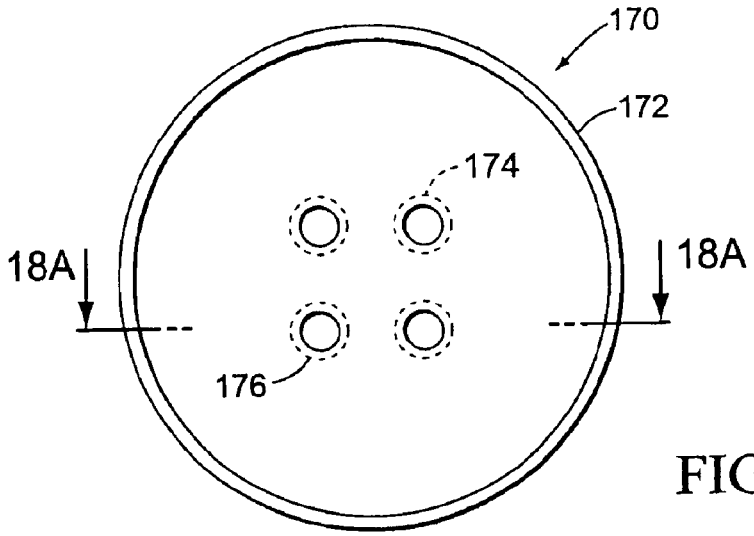
FIG. 18 is a top view of a flow inducing attachment for use on a four-barrel or four-throat carburetor.
Figure 18A:
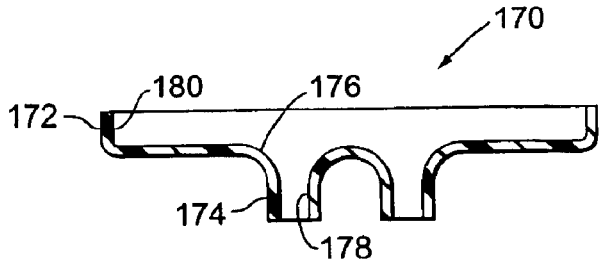
FIG. 18A is view of the flow inducing attachment of FIG. 18 through A—A thereof.
Figure 18B:
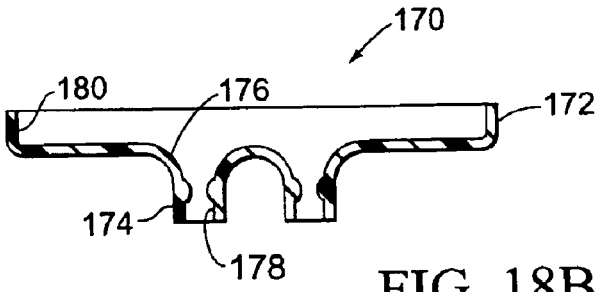
FIG. 18B is a view similar to FIG. 18A showing representations of venturis in the downwardly extending portions of the flow inducing attachment.

Thus, it would be advantageous to be able to further fine tune or optimize a carburetor for circumstances where there is an artificial reduction in air and fuel flow to and engine due to use of a restrictor plate. Shown in FIGS. 18–18B, and 19 are systems and methods for accomplishing that task. (The principle of this insert is shown and previously discussed with respect to FIG. 17.) Referring to FIGS. 18 and 18A, a carburetor optimizer or airflow enhancer is shown generally as 170. The optimizer 170 is cast, injection molded or otherwise machined or formed. In a preferred embodiment, the device 170 is formed with a generally bowl shaped upper portion 172. Projecting downwardly from the bowl shaped portion is a plurality of tubes, such as 174. These tubes are attached to, or formed integrally with, the bowl, through a smooth contour transition 176. The tubes have an internal diameter 178 that is large enough to accommodate a carburetor booster discussed further on. The bowl shaped upper portion may include a wall portion such as 180 that can be a very slight wall or it can be a taller wall as shown in FIG. 19. As will be readily recognized by those of ordinary skill in the art, the particular shape and number of the downwardly projecting tubes 174 will depend on the particular carburetor being used (i.e., sidedraft, downdraft, single-barrel, double barrel, four barrel, etc. An air box 194 can be fitted proximate the airflow enhancer 170.

An alternative embodiment of the flow enhancer 170 may not include any wall at all and instead have a generally concave or convex upper surface that provides the surface surrounding the tubes such as 176. FIG. 17 shows such a configuration.

As shown in FIG. 19, the flow enhancer 170, is shown proximate a schematic carburetor body 182 which has been broken away to reveal the carburetor booster venturi 184 located in the carburetor throat 186. Also shown in FIG. 19, is a restrictor plate 188, a carburetor mounting plate 190, and an intake manifold 192, all shown as sections of the actual components.

The downwardly projecting tubes or "air runners" 174 are formed in the same cross-sectional shape and of a desired length to end proximate the boosters. By adjusting the contour, transition, shape, diameter and length of the downwardly projecting tubes, the performance characteristics of the carburetor may be tuned, optimized and enhanced. Moreover, by creating numerous such enhancers 170, each with slightly different characteristics, the performance of the carburetor is easily changed simply by changing the enhancer 170. Thus, instead of having to change carburetors, one can simply change to a different enhancer 170.

It should be understood that the enhancer 170 provides an opportunity to easily alter several carburetor parameters. For example, the downwardly projecting tubes 174 may be formed to place a venturi above the booster as discussed in detail above in connection with FIGS. 15–17. Second, the diameter of the downwardly projecting tubes 174 can be adjusted to fine tune the volume of air passed through the booster 184. More specifically, the downwardly projecting tubes 174 are sized close to the diameter of the booster, to direct most of the incoming air through the booster. Alternatively, the air runner 174 may be sized larger than the booster 184, to allow some air to bypass the booster 184. The exact size and shape of the runners 174 will depend on the carburetor and engine characteristics.

By reducing the size of the "neck" or inlet opening of the throat of the carburetor, the flow enhancer 170 optimizes the performance of a carburetor relative to engine requirements. For example, if a restrictor plate is required, the flow enhancer 170 will more properly fit the carburetor to the air capacity or needs of the engine. In addition, the flow enhancer 170 will more effectively direct the reduced air capacity to the booster. If desired, the venturi may likewise be relocated by the flow enhancer 170. Each of these changes, alone and in combination, results in better, more efficient performance.

While particular embodiments of the invention have been shown and described, it will be apparent to those skilled in the art that changes and modifications may be made without departing from the invention in its broader aspects, and, therefore, the inventor's intent in the appended claims is to cover all such changes and modifications as fall within the spirit and scope of the invention and the following claims. For example, the turbulence inducing elements, rings, threads or fins or deflector tabs may take any conceivable form, as long as it at least partially disrupts the smooth wall surface of the fluid passage. Thus, while the drawings show rings and preferably threads, the invention is not limited thereto.

Likewise, the preferred embodiments use fuel as the primary fluid and air as the secondary fluid. However, the invention works well in any application where two fluids are mixed. Thus, while the preferred embodiments describe emulsification of air and fuel in carburetors for combustion engines, many alternative uses exist, including, for example, in furnaces, jet engines, turbines, painting, etc. Thus, the figures above show no dimensions, and are not to scale even as to related parts. This is because even one relatively small thread, ring or obstruction, located downstream of the inlet for the secondary fluid in a relatively large passage for a primary fluid, will nonetheless result in improved performance relative to the prior art. Of course, flow bench, engine dynamometer, and other testing will lead quickly to optimization of the specific configuration of the invention for each application.

Moreover, many of the inventions disclosed herein are useful both alone and in combination. For example, in non-fuel injected application, it is most desirable to include the emulsifying techniques of FIGS. 1–5, and 14, with the venturi placement and flow enhancer inserts of FIGS. 15–19.

What is claimed is:

1. A method for increasing the performance of a carburetor, the carburetor including a throat for containing a stream of air passing through the carburetor, a single fixed location venturi in the throat of the carburetor, the venturi defining the smallest inside diameter of the throat of the carburetor, a single throttle plate carried in the throat of the carburetor, and a single fuel supply port at a fixed location above the throttle plate for supplying fuel to the airstream passing through the throat of the carburetor, the method comprising the acts of:

locating the fuel supply port in the throat of the carburetor at a fixed location below the fixed location of the venturi and above the throttle plate;

forming a plurality of carburetor inserts, each carburetor insert having a venturi on an inner surface of the insert, the carburetor inserts of different physical characteristics, at least one characteristic being the location of the venturi in the throat of the carburetor; and selecting one of the carburetor mains to optimize the placement of the venturi relative to a booster in the throat of the carburetor for increased performance.

2. A method for increasing the performance of a carburetor, the carburetor including a throat for containing a stream of air passing through the carburetor, a fixed location venturi in the throat of the carburetor, the venturi defining the smallest inside diameter of the throat of the carburetor, a booster and a throttle plate positioned in the throat of the carburetor, a fuel supply port for supplying fuel to the air stream passing through the throat of the carburetor, the method comprising the acts of:

locating the fuel supply port in the throat of the carburetor at a fixed location below the fixed location of the venturi and above the throttle plate;

forming a plurality of carburetor inserts, each carburetor insect having a venturi on an inner surface of the insert, the carburetor inserts of different physical characteristics, at least one characteristic being the location of the venturi in the throat of the carburetor, and selecting one of the carburetor inserts to optimize the placement of the venturi relative to the booster in the throat of the carburetor for increased performance.

* * * * *